US011233336B2

(12) United States Patent
Park et al.

(10) Patent No.: US 11,233,336 B2
(45) Date of Patent: Jan. 25, 2022

(54) CHIP ANTENNA AND CHIP ANTENNA MODULE INCLUDING THE SAME

(71) Applicant: Samsung Electro-Mechanics Co., Ltd., Suwon-si (KR)

(72) Inventors: Ju Hyoung Park, Suwon-si (KR); Kyu Bum Han, Suwon-si (KR); Jae Yeong Kim, Suwon-si (KR); Jeong Ki Ryoo, Suwon-si (KR); Sung Nam Cho, Suwon-si (KR); Sung Yong An, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 137 days.

(21) Appl. No.: 16/670,139

(22) Filed: Oct. 31, 2019

(65) Prior Publication Data

US 2020/0259267 A1 Aug. 13, 2020

(30) Foreign Application Priority Data

Feb. 8, 2019 (KR) ..... 10-2019-0015001
Jul. 5, 2019 (KR) ..... 10-2019-0081483

(51) Int. Cl.
*H01Q 1/38* (2006.01)
*H01Q 21/00* (2006.01)
(Continued)

(52) U.S. Cl.
CPC ..... *H01Q 21/0025* (2013.01); *H01Q 1/243* (2013.01); *H01Q 1/48* (2013.01);
(Continued)

(58) Field of Classification Search
CPC ..... H01Q 19/10; H01Q 1/22; H01Q 1/2283; H01Q 1/24; H01Q 1/243; H01Q 1/38;
(Continued)

(56) References Cited

U.S. PATENT DOCUMENTS 5,023,624 A * 6/1991 Heckaman ..... H01L 23/66 333/247
5,903,239 A * 5/1999 Takahashi ..... H01Q 1/2283 343/700 MS
6,982,672 B2 * 1/2006 Lin ..... H01Q 1/38 343/700 MS
7,187,328 B2 * 3/2007 Tanaka ..... H01Q 9/0407 343/700 MS
(Continued)

FOREIGN PATENT DOCUMENTS

JP 2003-283239 A 10/2003
KR 10-0542829 B1 1/2006
(Continued)

OTHER PUBLICATIONS

Korean Office Action dated Feb. 19, 2020 In Counterpart Korean Patent Application No. 10-2019-0081483 (7 Pages in English and 6 Pages in Korean).

*Primary Examiner* — Tho G Phan
(74) *Attorney, Agent, or Firm* — NSIP Law

(57) ABSTRACT

A chip antenna includes a first ceramic substrate, a second ceramic substrate disposed to face the first ceramic substrate, a first patch disposed on one surface of the first ceramic substrate to operate as a feeding patch, a second patch disposed on the second ceramic substrate to operate as a radiation patch, at least one feed via penetrating through the first ceramic substrate in a thickness direction to provide a feed signal to the first patch, and a bonding pad disposed on a second surface of the first ceramic substrate opposite the first surface. A thickness of the first ceramic substrate is greater than a thickness of the second ceramic substrate.

19 Claims, 17 Drawing Sheets

(51) Int. Cl.

| | |
|---|---|
| ***H01Q 21/06*** | (2006.01) |
| ***H01Q 1/24*** | (2006.01) |
| ***H01Q 1/48*** | (2006.01) |
| ***H01Q 19/10*** | (2006.01) |
| ***H01Q 9/04*** | (2006.01) |

(52) U.S. Cl.
CPC ..... *H01Q 9/045* (2013.01); *H01Q 19/10* (2013.01); *H01Q 21/065* (2013.01)

(58) Field of Classification Search
CPC ..... H01Q 1/48; H01Q 21/00; H01Q 21/0025; H01Q 21/06; H01Q 21/065; H01Q 9/04; H01Q 9/045; H01Q 21/24; H01Q 21/28; H01Q 9/0414
See application file for complete search history.

(56) References Cited

U.S. PATENT DOCUMENTS

| | | | | |
|---|---|---|---|---|
| 9,245,858 | B2 * | 1/2016 | Han | H01L 21/561 |
| 2005/0054317 | A1 | 3/2005 | Ro et al. | |
| 2010/0090903 | A1 * | 4/2010 | Byun | H01Q 13/18 343/700 MS |
| 2018/0219281 | A1 | 8/2018 | Sudo et al. | |

FOREIGN PATENT DOCUMENTS

| | | | |
|---|---|---|---|
| KR | 10-2006-0078635 | A | 7/2006 |
| KR | 10-2009-0068799 | A | 6/2009 |
| KR | 10-2010-0059257 | A | 6/2010 |
| KR | 10-2018-0089853 | A | 8/2018 |

* cited by examiner

CHIP ANTENNA AND CHIP ANTENNA MODULE INCLUDING THE SAME

CROSS-REFERENCE TO RELATED APPLICATIONS

This application claims benefit under 35 USC 119(a) of Korean Patent Application No. 10-2019-0015001 filed on Feb. 8, 2019 and Korean Patent Application No. 10-2019-0081483 filed on Jul. 5, 2019 in the Korean Intellectual Property Office, the entire disclosures of which are incorporated herein by reference for all purposes.

BACKGROUND

1. Field

The following description relates to a chip antenna and a chip antenna module including the same.

2. Description of Background 5G communications systems are implemented to use higher frequency (mmWave) bands, such as 10 GHz to 100 GHz bands, to obtain higher rates of data transmission. Beamforming, massive multiple-input multiple-output (MIMO), full dimensional multiple-input multiple-output (MIMO), array antennas, analog beamforming, and large scale antenna techniques to reduce propagation loss of radio frequency (RF) signals and increase transmission distances are discussed in 5G communication systems.

Mobile communications terminals such as mobile phones, personal digital assistants (PDAs), navigation devices, notebooks, and the like, supporting wireless communications, are developing a trend of having adding functions such as code-division multiple access (CDMA), wireless local area network (LAN), digital multimedia broadcasting (DMB), Near Field Communications (NFC), and the like. One of such important parts thereof is an antenna.

However, in the GHz band to which the 5G communication system is applied, it may be difficult to use existing antennas because the wavelength may be reduced to about several mm. Accordingly, there is demand for a chip antenna module suitable for the GHz band while having an extremely small size that may be mounted in a mobile communication terminal.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

Examples provide a chip antenna that may be used in a GHz band, and a chip antenna module including the same.

In one general aspect, a chip antenna includes a first ceramic substrate, a second ceramic substrate disposed to face the first ceramic substrate, a first patch disposed on one surface of the first ceramic substrate to operate as a feeding patch, a second patch disposed on the second ceramic substrate to operate as a radiation patch, at least one feed via penetrating through the first ceramic substrate in a thickness direction to provide a feed signal to the first patch, and a bonding pad disposed on a second surface of the first ceramic substrate opposite the first surface. A thickness of the first ceramic substrate is greater than a thickness of the second ceramic substrate.

The thickness of the first ceramic substrate may be equal to two to three times the thickness of the second ceramic substrate.

The thickness of the first ceramic substrate may be 150 to 500 μm.

The thickness of the second ceramic substrate may be 50 to 200 μm.

The chip antenna may include a spacer disposed between the first ceramic substrate and the second ceramic substrate.

The chip antenna may include a bonding layer disposed between the first ceramic substrate and the second ceramic substrate.

A dielectric constant of the bonding layer may be lower than a dielectric constant of the first ceramic substrate and a dielectric constant of the second ceramic substrate.

In another general aspect, a chip antenna module includes a substrate including a plurality of wiring layers alternately stacked with a plurality of insulating layers; and a chip antenna. The chip antenna includes a first ceramic substrate including a first patch to which a feed signal is applied, and the first ceramic substrate is disposed on one surface of the substrate; and a second ceramic substrate including a second patch coupled to the first patch, and the second ceramic substrate is disposed to face the first ceramic substrate. A dielectric constant of the first ceramic substrate and a dielectric constant of the second ceramic substrate are higher than a dielectric constant of the insulating layers.

The dielectric constant of the insulating layers may be 3 to 4.

The dielectric constant of each of the first ceramic substrate and the second ceramic substrate may be 5 to 12.

The dielectric constant of the first ceramic substrate may be the same as the dielectric constant of the second ceramic substrate.

An overall dielectric constant of the chip antenna may be lower than the dielectric constant of the first ceramic substrate and the dielectric constant of the second ceramic substrate.

The chip antenna module may include a spacer disposed between the first ceramic substrate and the second ceramic substrate.

The chip antenna module may include a bonding layer disposed on the first ceramic substrate and the second ceramic substrate, and a dielectric constant of the bonding layer may be lower than the dielectric constant of each of the first ceramic substrate and the second ceramic substrate.

The first patch may be disposed on one surface of the first ceramic substrate facing the second ceramic substrate.

A distance from a ground layer reflecting a radio frequency (RF) signal of the chip antenna in an oriented direction, from among the plurality of wiring layers of the substrate, to the first patch, may correspond to $\lambda/10$ to $\lambda/20$, where $\lambda$ is wavelength of the RF signal transmitted and received by the chip antenna.

In another general aspect, a chip antenna module includes a substrate and a chip antenna. The chip antenna includes a first ceramic substrate disposed on a first surface of the substrate and including a feed patch; and a second ceramic substrate disposed on the first surface of the substrate and spaced apart from the first ceramic substrate in a direction normal to the first surface of the substrate, and the second ceramic substrate includes a radiation patch. A dielectric constant of the first ceramic substrate and a dielectric constant of the second ceramic substrate are higher than a dielectric constant of the substrate.

The radiation patch may include a first radiation patch electromagnetically coupled to the feed patch and disposed on a first surface of the second ceramic substrate that faces the feed patch; and a second radiation patch electromagnetically coupled to the feed patch and disposed on a second surface of the second ceramic substrate opposite to the first surface of the second ceramic substrate.

The chip antenna module may include a shielding electrode insulated from the second radiation patch and disposed along a periphery of the second surface of the second ceramic substrate.

The feed patch may be disposed on a first surface of the first ceramic substrate opposite the first surface of the substrate and bonded to a first surface of the second ceramic substrate that faces the first surface of the of the first ceramic substrate, and the radiation patch may be disposed on a second surface of the second ceramic substrate opposite the first surface of the second ceramic substrate.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
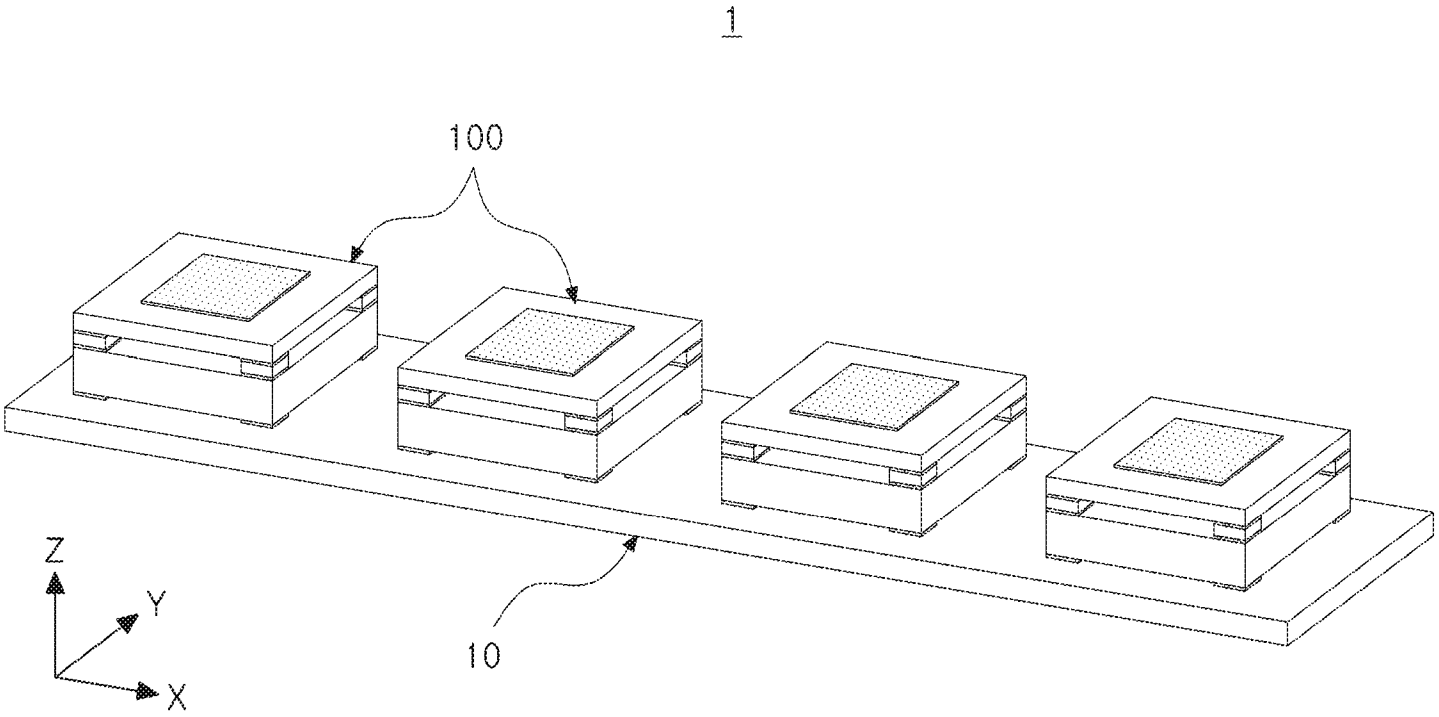
FIG. 1 is a perspective view of a chip antenna module according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and examples are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

The drawings may not be to scale, and the relative sizes, proportions, and depictions of elements in the drawings may be exaggerated for clarity, illustration, and convenience.

Subsequently, examples are described in further detail with reference to the accompanying drawings.

A chip antenna module described herein operates in the high frequency region and, for example, may operate in the frequency band of 3 GHz or more. In addition, the chip antenna module described herein may be mounted on an electronic device configured to receive, or transmit and receive an RF signal. For example, the chip antenna may be mounted on a portable telephone, a portable notebook, a drone, or the like.

Figure 2A:
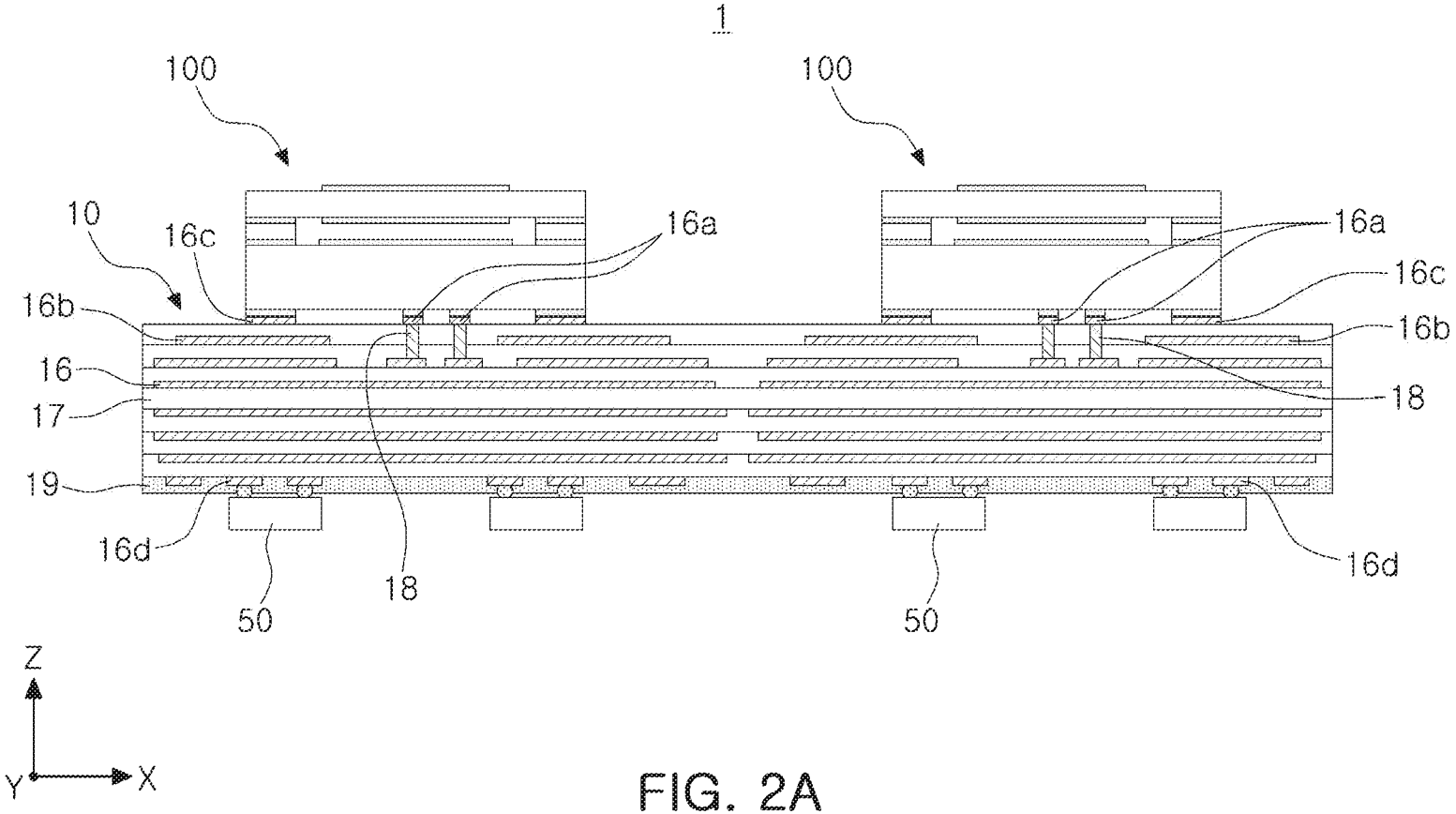
FIG. 2A is a cross-sectional view of a portion of the chip antenna module of FIG. 1.
Figure 3A:
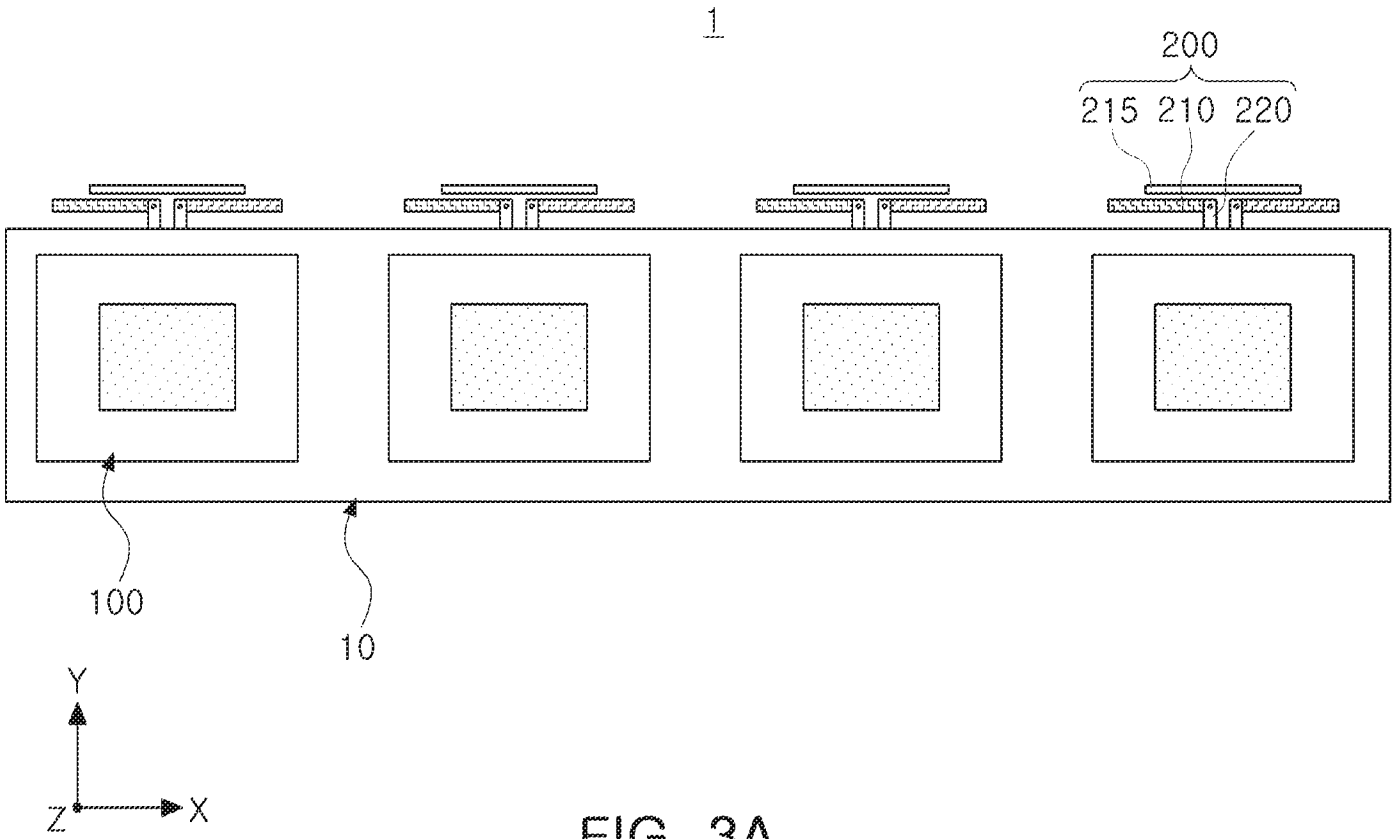
FIG. 3A is a plan view of the chip antenna module of FIG. 1.
Figure 3B:
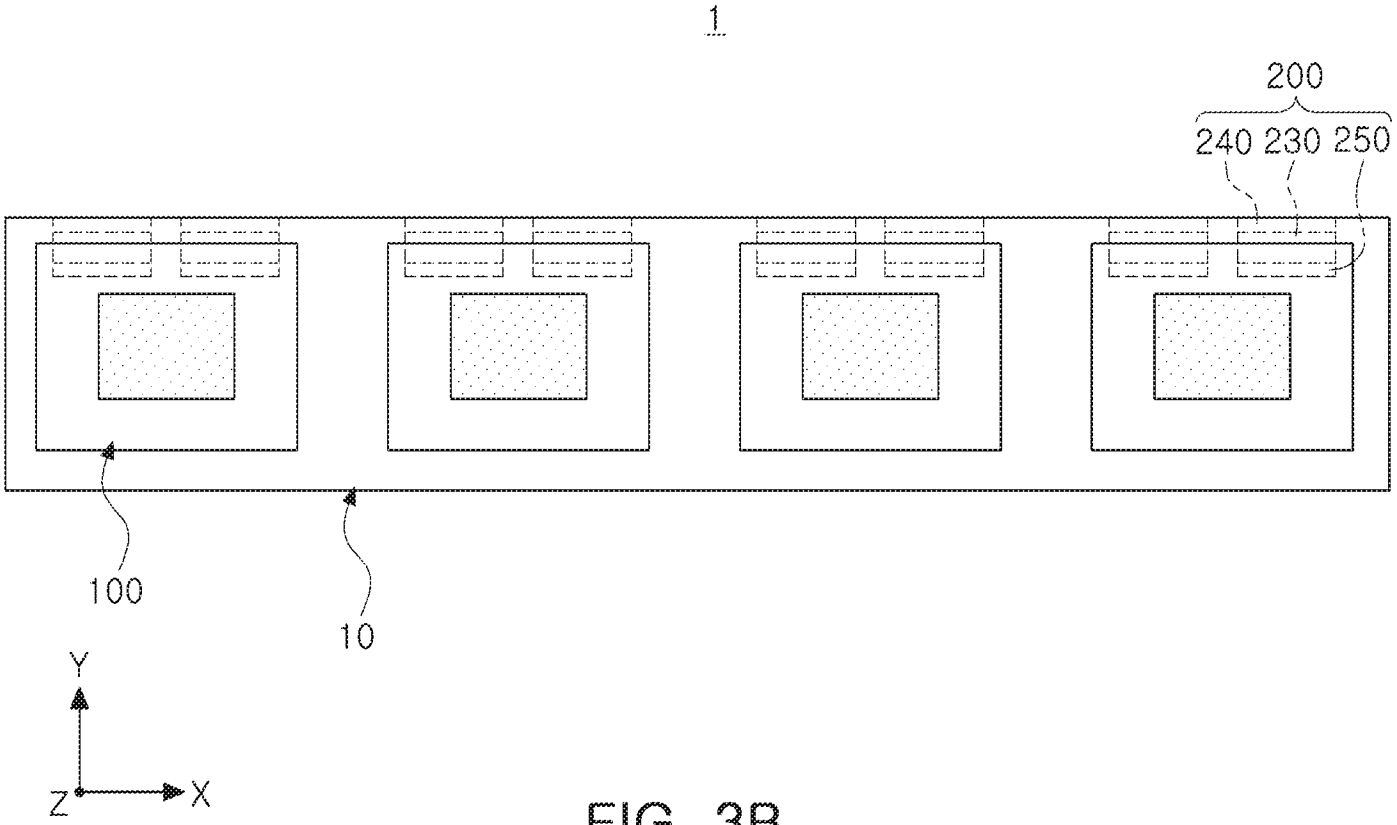
FIG. 3B illustrates a modified example of the chip antenna module of FIG. 3A.

FIG. 1 is a perspective view of a chip antenna module according to an example, FIG. 2A is a cross-sectional view illustrating a portion of the chip antenna module of FIG. 1, FIG. 3A is a plan view of the chip antenna module of FIG. 1, and FIG. 3B illustrates a modified example of the chip antenna module of 3A.

Referring to FIGS. 1, 2A and 3A, a chip antenna module 1 according to an example includes a substrate 10, an electronic device 50, and a chip antenna 100, and may further include an end-fire antenna 200. At least one electronic device 50, a plurality of chip antennas 100, and a plurality of end-fire antennas 200 may be disposed on the substrate 10.

The substrate 10 may be a circuit board on which a circuit or electronic component required for the chip antenna 100 is mounted. As an example, the substrate 10 may be a printed circuit board (PCB) having one or more electronic components mounted on a surface thereof. Therefore, the substrate 10 may be provided with a circuit wiring electrically connecting electronic components. The substrate 10 may be implemented as a flexible substrate, a ceramic substrate, a glass substrate, or the like. The substrate 10 may include a plurality of layers. The substrate 10 may be formed of a multilayer substrate in which at least one insulating layer 17 and at least one wiring layer 16 are alternately stacked. The at least one wiring layer 16 may include two outer layers provided on one surface and the other surface of the substrate 10 and at least one inner layer provided between the two outer layers. For example, the insulating layer 17 may be formed of an insulating material such as prepreg, Ajinomoto build-up film (ABF), FR-4, and bismaleimide triazine (BT). The insulating material may be formed of a thermosetting resin such as an epoxy resin or a thermoplastic resin such as polyimide, or formed by impregnating the resin with a core material such as glass fiber, glass cloth or glass fabric, together with an inorganic filler. In some examples, the insulating layer 17 may be formed of a photoimageable dielectric resin.

The wiring layer 16 electrically connects the electronic device 50, the plurality of chip antennas 100, and the plurality of end fire antennas 200. The wiring layer 16 may electrically connect the plurality of electronic devices 50, the plurality of chip antennas 100, and the plurality of end fire antennas 200 externally.

The wiring layer 16 may be formed of a conductive material, such as copper (Cu), aluminum (Al), silver (Ag), tin (Sn), gold (Au), nickel (Ni), lead (Pb), titanium (Ti), alloys thereof, or the like.

In the insulating layer 17, wiring vias 18 are disposed to interconnect the wiring layers 16.

The chip antenna 100 is mounted on one surface of the substrate 10, for example, on an upper surface (in a Z-axis direction) of the substrate 10. The chip antenna 100 has a width extending in a Y-axis direction, a length extending in an X-axis direction that intersects with the Y-axis direction, for example, to be perpendicular to the Y-axis direction, and a height extending in a Z-axis direction. As illustrated in FIG. 1, the chip antenna 100 may be disposed in a structure of n×1. For example, a plurality of the chip antennas 100 may be arranged in the X-axis direction, and widths of two chip antennas 100 adjacent to each other in the X-axis direction among the plurality of chip antennas 100 may face each other.

According to an example, the chip antennas 100 may be arranged in a structure of n×m. The plurality of chip antennas 100 are arranged in the X-axis direction and the Y-axis direction, in such a manner that two chip antennas adjacent to each other in the Y-axis direction among the plurality of chip antennas 100 may face each other in the Y-axis direction, and two chip antennas 100 adjacent to each other in the X-axis direction may face each other in the X-axis direction.

Centers of the chip antennas 100 adjacent to each other in at least one of the X-axis direction and the Y-axis direction may be spaced apart from each other by $\lambda/2$. In this case, A represents the wavelength of an RF signal transmitted and received by the chip antennas 100.

When the chip antenna module 1 according to an example transmits and receives an RF signal in a 20 GHz to 40 GHz band, the centers of adjacent chip antennas 100 may be spaced apart by 3.75 mm to 7.5 mm, and when the chip antenna module 1 transmits and receives an RF signal in a 28 GHz band, the centers of adjacent chip antennas 100 may be spaced apart by 5.36 mm.

The RF signal used in the 5G communication system has a shorter wavelength and greater energy than those of the RF signal used in a 3G/4G communication system. Therefore, to significantly reduce interference between RF signals transmitted and received at the respective chip antennas 100, the chip antennas 100 are required to have a sufficient separation distance.

According to an example, the centers of the chip antennas 100 are sufficiently spaced apart by $\lambda/2$ to significantly reduce interference between the RF signals transmitted and received by the respective chip antennas 100, thereby using the chip antenna 100 in the 5G communication system.

According to an example, a separation distance between the centers of adjacent chip antennas 100 may be smaller than λ/2. As will be described later, each of the chip antennas 100 is comprised of ceramic substrates and at least one patch provided on a portion of the ceramic substrates. In this case, the ceramic substrates may be spaced apart from each other by a predetermined distance, or a material having a lower dielectric constant than that of the ceramic substrates may be disposed between the ceramic substrates, thereby lowering an overall dielectric constant of the chip antenna 100. As a result, since the wavelength of the RF signal transmitted and received by the chip antenna 100 may be increased to improve radiation efficiency and gain, even when the adjacent chip antennas 100 are arranged such that the separation distance between centers of the adjacent chip antennas 100 is smaller than λ/2 of the RF signal, interference between RF signals may be significantly reduced. When the chip antenna module 1 according to an example transmits and receives an RF signal in a 28 GHz band, a separation distance between centers of adjacent chip antennas 100 may be smaller than 5.36 mm.

An upper surface of the substrate 10 is provided with a feeding pad 16*a* providing a feed signal to the chip antenna 100. A ground layer 16*b* is provided in any one inner layer among a plurality of layers of the substrate 10. As an example, the wiring layer 16 disposed on a lowermost layer in an upper surface of the substrate 10 is used as a ground layer 16*b*. The ground layer 16*b* acts as a reflector of the chip antenna 100. Therefore, the ground layer 16*b* may concentrate the RF signal by reflecting the RF signal output from the chip antenna 100 in the Z-axis direction corresponding to an oriented direction.

In FIG. 2A, the ground layer 16*b* is illustrated as being disposed in a lowermost layer in an upper surface of the substrate 10. However, according to an example, the ground layer 16*b* may be provided in the upper surface of the substrate 10 and may also be provided in other layers.

An upper surface pad 16*c* is provided on the upper surface of the substrate 10 to be bonded to the chip antenna 100. The electronic device 50 may be mounted on the other surface of the substrate 10, for example, on the lower surface of the substrate 10 opposite the chip antenna 100. A lower surface of the substrate 10 is provided with a lower surface pad 16*d* electrically connected to the electronic device 50.

An insulating protective layer 19 may be disposed on the lower surface of the substrate 10. The insulating protective layer 19 is disposed in such a manner as to cover the insulating layer 17 and the wiring layer 16 on the lower surface of the substrate 10, to protect the wiring layer 16 disposed on the lower surface of the insulating layer 17. As an example, the insulating protective layer 19 may include an insulating resin and an inorganic filler. The insulating protective layer 19 may have an opening that exposes at least a portion of the wiring layer 16. The electronic device 50 may be mounted on the lower surface pad 16*d* through a solder ball disposed in the opening.

Figure 2B:
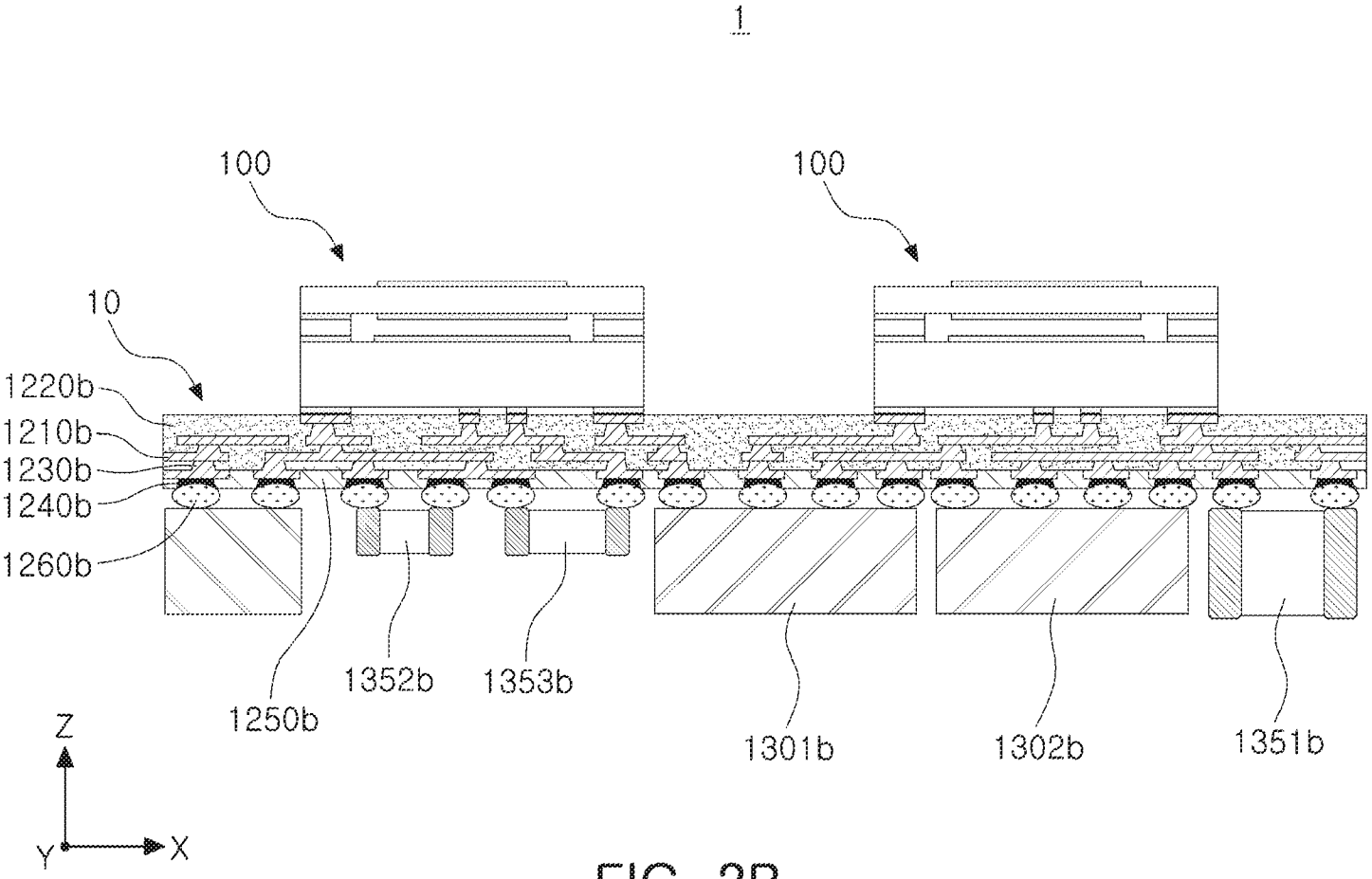
FIGS. 2B and 2C illustrate a modified example of the chip antenna module of FIG. 2A.
Figure 2C:
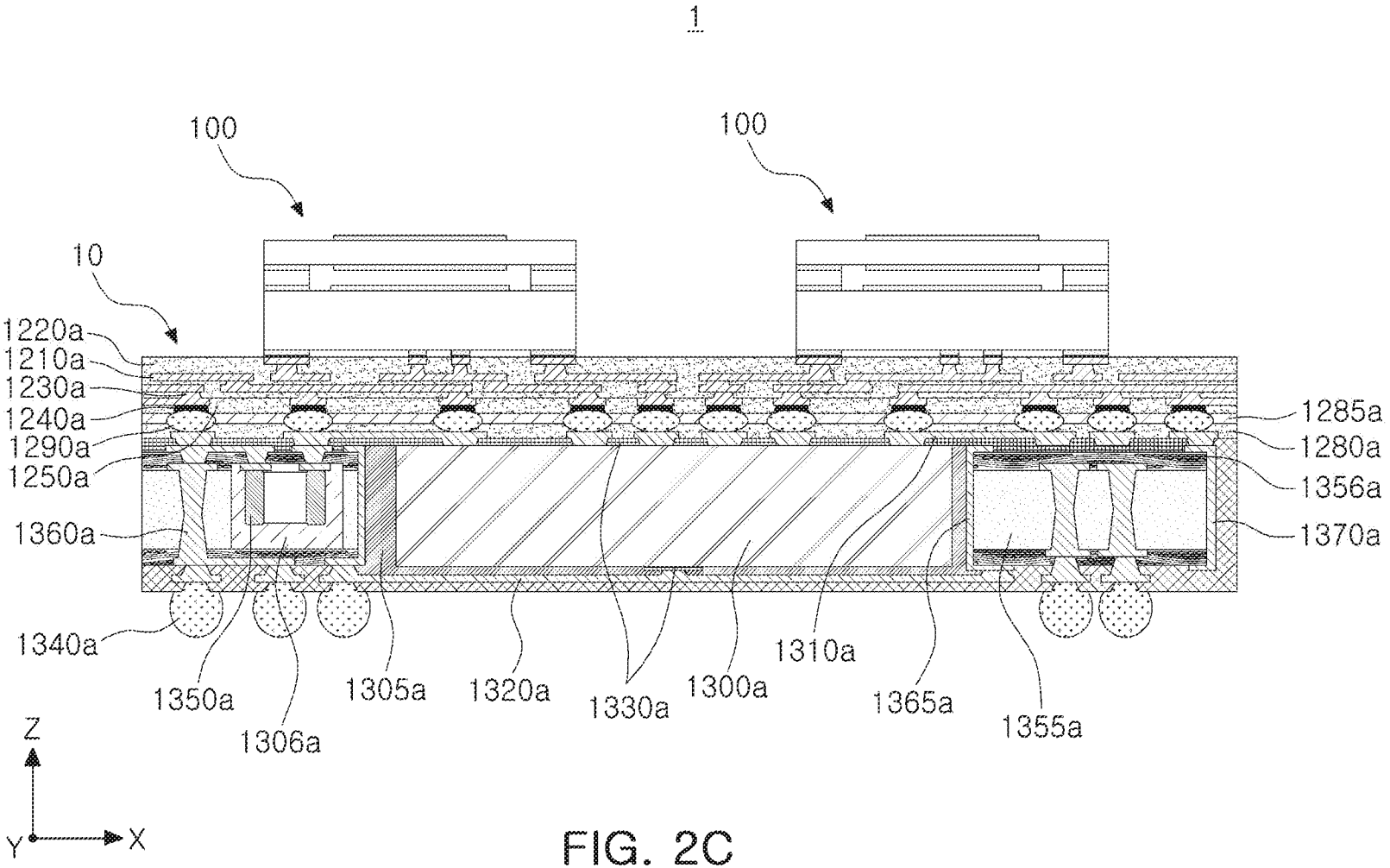

FIGS. 2B and 2C illustrate a modified example of the chip antenna module of FIG. 2A.

Since the chip antenna module according to the example of FIGS. 2B and 2C is similar to the chip antenna module of FIG. 2A, overlapping descriptions will be omitted and descriptions will be made based on differences.

Referring to FIG. 2B, the substrate 10 includes at least one wiring layer 1210*b*, at least one insulating layer 1220*b*, a wiring via 1230*b* connected to at least one wiring layer 1210*b*, a connection pad 1240*b* connected to the wiring via 1230*b*, and a solder resist layer 1250*b*. The substrate 10 may have a structure similar to a copper redistribution layer (RDL). A chip antenna 100 may be disposed on the upper surface of the substrate 10.

An integrated circuit (IC) 1301*b*, a power management integrated circuit (PMIC) 1302*b*, and a plurality of passive components 1351*b*, 1352*b* and 1353*b* may be mounted on the lower surface of the substrate 10 through a solder ball 1260*b*. The IC 1301*b* corresponds to an IC for operating the chip antenna module 1. The PMIC 1302*b* generates power and may transfer the generated power to the IC 1301*b* through at least one wiring layer 1210*b* of the substrate 10.

The plurality of passive components 1351*b*, 1352*b* and 1353*b* may provide impedance to the IC 1301*b* and/or the PMIC 1302*b*. For example, the plurality of passive components 1351*b*, 1352*b* and 1353*b* may include at least a portion of a capacitor, an inductor and a chip resistor, such as a multilayer ceramic capacitor (MLCC) or the like.

Referring to FIG. 2C, the substrate 10 may include at least one wiring layer 1210*a*, at least one insulating layer 1220*a*, a wiring via 1230*a*, a connection pad 1240*a*, and a solder resist layer 1250*a*.

An electronic component package is mounted on the lower surface of the substrate 10. The electronic component package includes an IC 1300*a*, an encapsulant 1305*a* encapsulating at least a portion of the IC 1300*a*, a support member 1355*a* having a first side facing the IC 1300*a*, at least one wiring layer 1310*a* electrically connected to the IC 1300*a* and the support member 1355*a*, and a connection member including an insulating layer 1280*a*.

The RF signal generated by the IC 1300*a* may be transmitted to the substrate 10 through at least one wiring layer 1310*a* to be transmitted toward the upper surface of the chip antenna module 1, and the RF signal received by the chip antenna module 1 may be transmitted to the IC 1300*a* through at least one wiring layer 1310*a*.

The electronic component package may further include a connection pad 1330*a* disposed on one surface and/or the other surface of the IC 1300*a*. The connection pad 1330*a* disposed on one surface of the IC 1300*a* may be electrically connected to at least one wiring layer 1310*a*, and the connection pad 1330*a* disposed on the other surface of the IC 1300*a* may be electrically connected to the support member 1355*a* or a core plating member 1365*a* through a bottom wiring layer 1320*a*. The core plating member 1365*a* may provide ground to the IC 1300*a*.

The support member 1355*a* may include a core dielectric layer 1356*a* and at least one core via 1360*a* that penetrates through the core dielectric layer 1356*a* and is electrically connected to the bottom wiring layer 1320*a*. The at least one core via 1360*a* may be electrically connected to an electrical connection structure 1340*a* such as a solder ball, a pin, and a land. Accordingly, the support member 1355*a* may receive a base signal or power from the lower surface of the substrate 10 and transmit the base signal and/or power to the IC 1300*a* through the at least one wiring layer 1310*a*.

The IC 1300*a* may generate an RF signal of a millimeter wave (mmWave) band using the base signal and/or power. For example, the IC 1300*a* may receive a low frequency base signal and perform frequency conversion, amplification, filtering phase control, and power generation of the base signal. The IC 1300*a* may be formed of one of a compound semiconductor (for example, GaAs) and a silicon semiconductor to implement high frequency characteristics. The electronic component package may further include a passive component 1350*a* electrically connected to the at least one wiring layer 1310*a*. The passive component 1350*a* may be disposed in an accommodation space 1306*a* provided by the support member 1355*a*. The passive component 1350*a* may include at least a portion of a multilayer ceramic capacitor (MLCC), an inductor, and a chip resistor.

The electronic component package may include core plating members 1365*a* and 1370*a* disposed on side surfaces of the support member 1355*a*. The core plating members 1365*a* and 1370*a* may provide ground to the IC 1300*a*, and may radiate heat from the IC 1300*a* externally or remove noise introduced into the IC 1300*a*.

The configuration of the electronic component package excluding the connection member, and the connection member, may be independently manufactured and combined, but may also be manufactured together according to a design. Although FIG. 2C illustrates that the electronic component package is coupled to the substrate 10 through an electrical connection structure 1290*a* and a solder resist layer 1285*a*, the electrical connection structure 1290*a* and the solder resist layer 1285*a* may be omitted according to an example.

Referring to FIG. 3A, the chip antenna module 1 may further include at least one or more end-fire antennas 200. Each of the end-fire antennas 200 may include an end-fire antenna pattern 210, a director pattern 215, and an end-fire feedline 220.

The end-fire antenna pattern 210 may transmit or receive an RF signal in a lateral direction. The end-fire antenna pattern 210 may be disposed on the side of the substrate 10 and may be formed to have a dipole form or a folded dipole form. The director pattern 215 may be electromagnetically coupled to the end-fire antenna pattern 210 to improve the gain or bandwidth of the plurality of end-fire antenna patterns 210. The end-fire feedline 220 may transmit the RF signal received from the end-fire antenna pattern 210 to an electronic device or an IC, and transmit an RF signal received from the electronic device or IC to the end-fire antenna pattern 210.

The end-fire antenna 200 formed by the wiring pattern of FIG. 3A may be implemented as an end-fire antenna 200 having a chip shape, as illustrated in FIG. 3B.

Referring to FIG. 3B, each of the end-fire antennas 200 includes a body portion 230, a radiating portion 240, and a ground portion 250.

The body portion 230 has a hexahedral shape and is formed of a dielectric substance. For example, the body portion 230 may be formed of a polymer or ceramic sintered body having a predetermined dielectric constant.

The radiating portion 240 is bonded to a first surface of the body portion 230, and the ground portion 250 is bonded to a second surface opposing the first surface of the body portion 230. The radiating portion 240 and the ground portion 250 may be formed of the same material. The radiating portion 240 and the ground portion 250 may be formed of a material selected from silver (Ag), gold (Au), copper (Cu), aluminum (Al), platinum (Pt), titanium (Ti), molybdenum (Mo), nickel (Ni), and tungsten (W), or an alloy of two or more thereof. The radiating portion 240 and the ground portion 250 may be formed to have the same shape and the same structure. The radiating portion 240 and the ground portion 250 may be distinct from each other depending on the type of the pad to be bonded when mounted on the substrate 10. For example, of the radiating portion 240 and the ground portion 250, a portion bonded to a feeding pad may function as the radiating portion 240, and a portion bonded to a ground pad may function as the ground portion 250.

Since the chip-type end-fire antenna 200 has a capacitance due to the dielectric between the radiating portion 240 and the ground portion 250, a coupling antenna may be designed or the resonance frequency may be tuned using the capacitance.

To secure sufficient antenna characteristics of a patch antenna implemented to have a pattern form in a multilayer substrate, a plurality of layers is required in the substrate, which causes a problem in which the volume of the patch antenna is excessively increased. The problem may be solved by disposing an insulator having a relatively high dielectric constant in the multilayer substrate to form a thinner insulator and by reducing the size and thickness of an antenna pattern.

However, in a case in which the dielectric constant of an insulator is increased, the wavelength of an RF signal is shortened, and the RF signal is trapped in the insulator having a high dielectric constant, resulting in a significant reduction in radiation efficiency and gain of the RF signal.

Therefore, according to an example of the present disclosure, a patch antenna implemented to have a pattern form in the multilayer substrate may be implemented to have a chip form, thereby significantly reducing the number of layers of the substrate on which the chip antenna is mounted. Thereby, the manufacturing cost and volume of the chip antenna module 1 of this example may be reduced.

In addition, according to an example of the present disclosure, the dielectric constant of ceramic substrates provided in the chip antenna 100 may be higher than that of an insulating layer provided in the substrate 10, thereby miniaturizing the chip antenna 100.

Furthermore, the ceramic substrates of the chip antenna 100 may be spaced apart from each other by a predetermined distance, or a material having a lower dielectric constant than that of the ceramic substrates may be disposed between the ceramic substrates to lower an overall dielectric constant of the chip antenna 100. Thus, while miniaturizing the chip antenna module 1, the wavelength of the RF signal may be increased, thereby improving radiation efficiency and gain. In this case, the overall dielectric constant of the chip antenna 100 may be a dielectric constant formed by the ceramic substrates and a gap between and the ceramic substrates of the chip antenna 100 or a dielectric constant formed by the ceramic substrates of the chip antenna 100 or a material disposed between the ceramic substrates. Therefore, when the ceramic substrates of the chip antenna 100 are spaced apart by a predetermined distance, or a material having a lower dielectric constant than that of the ceramic substrates is disposed between the ceramic substrates, the overall dielectric constant of the chip antenna 100 may be lower than that of the ceramic substrates.

Figure 4A:
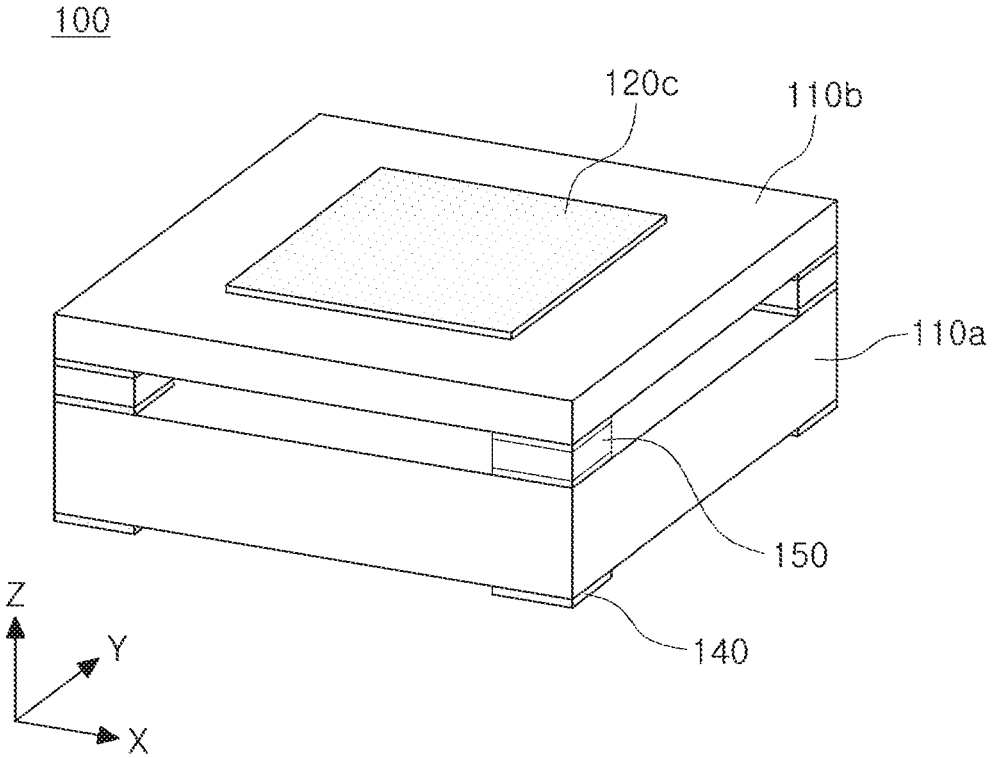
FIG. 4A is a perspective view of a chip antenna according to a first example.
Figure 4B:
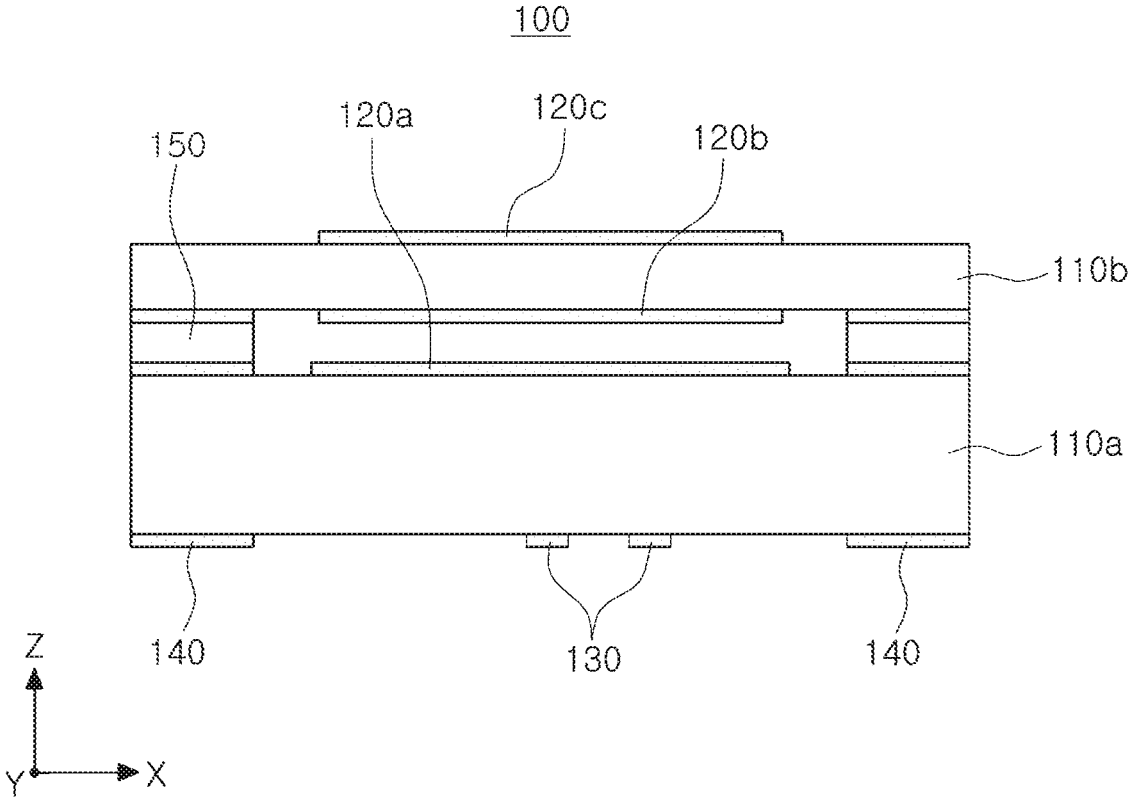
FIG. 4B is a side view of the chip antenna of FIG. 4A.
Figure 4C:
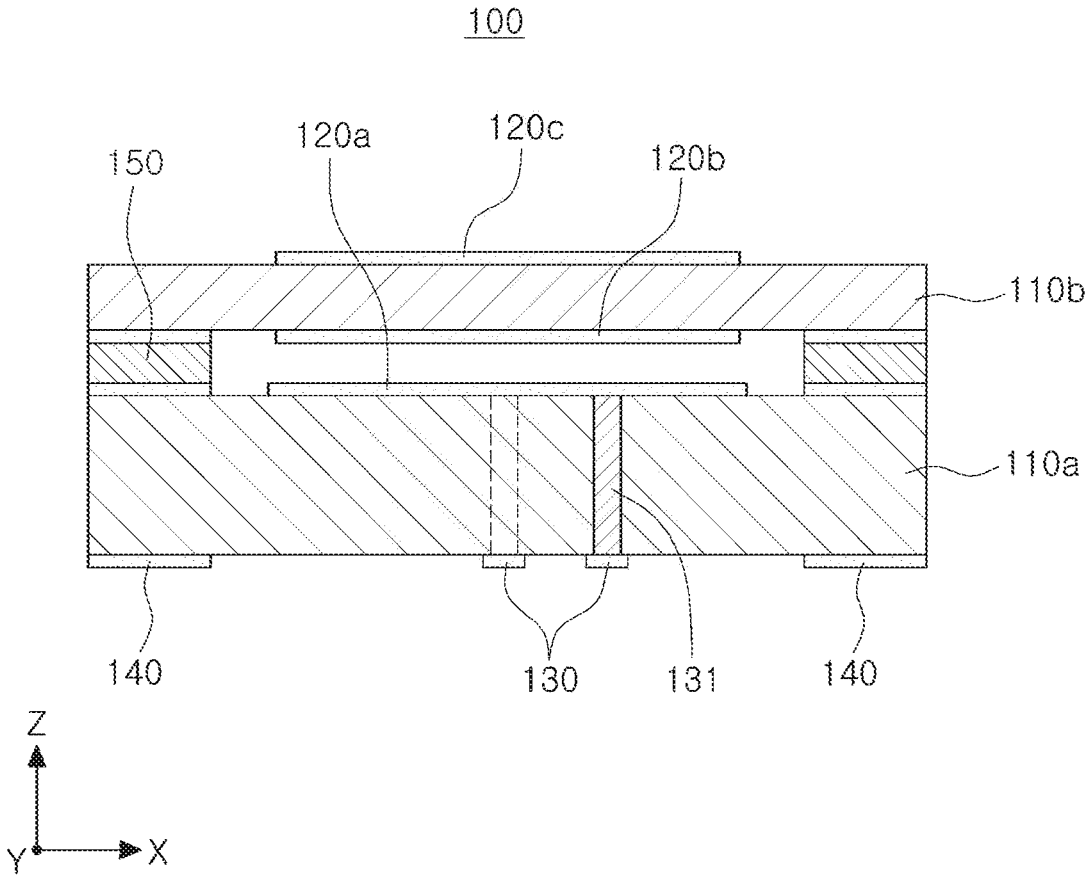
FIG. 4C is a cross-sectional view of the chip antenna of FIG. 4A.
Figure 4D:
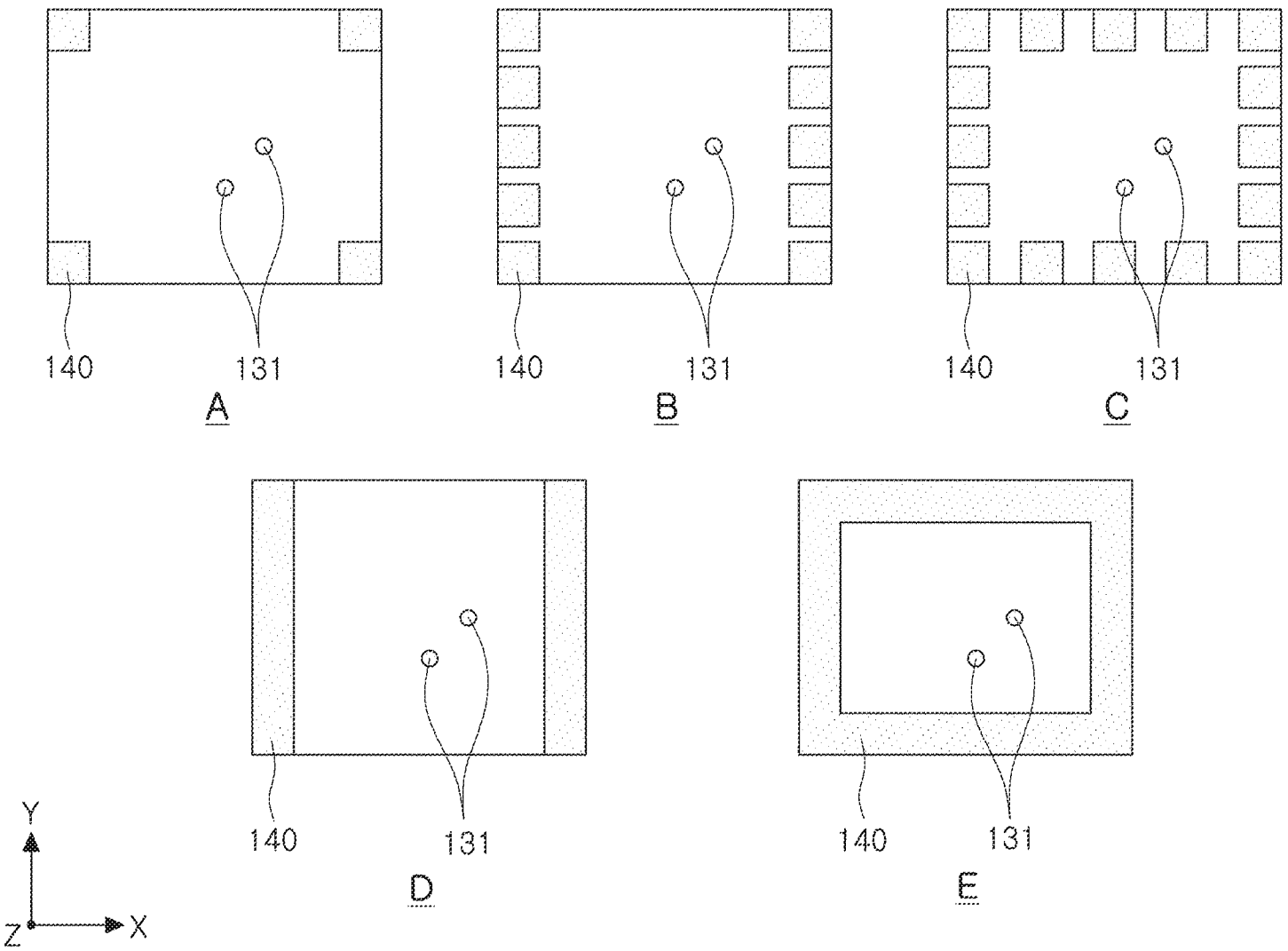
FIG. 4D is a bottom view of the chip antenna of FIG. 4A.

FIG. 4A is a perspective view of a chip antenna according to a first example, FIG. 4B is a side view of the chip antenna of FIG. 4A, FIG. 4C is a cross-sectional view of the chip antenna of FIG. 4A, and FIG. 4D is a bottom view of the chip antenna of FIG. 4A. 4E is a perspective view illustrating a modified example of the chip antenna of FIG. 4A.

In FIGS. 4A, 4B, 4C and 4D, a chip antenna 100 may include a first ceramic substrate 110*a*, a second ceramic substrate 110*b*, and a first patch 120*a*, and may include at least one of a second patch 120*b* and a third patch 120*c*.

The first patch 120*a* is formed of a metal having a flat plate shape with a predetermined area (cross-sectional area). The first patch 120*a* is formed to have a quadrangular shape. According to an example, the first patch 120*a* may have various shapes such as a polygonal shape, a circular shape or the like. The first patch 120*a* may be connected to a feed via 131 to function and operate as a feed patch.

The second patch 120*b* and the third patch 120*c* are disposed to be spaced apart from the first patch 120*a* by a predetermined distance, and are formed of a flat plate-shaped metal. The second patch 120*b* and the third patch 120*c* have the same area as or a different area from that of the first patch 120*a*. As an example, the second patch 120*b* and the third patch 120*c* may have a smaller area than that of the first patch 120*a* and may be disposed on the first patch 120*a*. As an example, the second patch 120*b* and the third patch 120*c* may be formed to be 5% to 8% smaller than the first patch 120*a*. For example, a thickness of each of the first patch 120*a*, the second patch 120*b*, and the third patch 120C may be 20 μm.

The second patch 120*b* and the third patch 120*c* may be electromagnetically coupled to the first patch 120*a* to function and operate as a radiation patch. The second patch 120*b* and the third patch 120*c* may further concentrate the RF signal in the Z direction corresponding to a mounting direction of the chip antenna 100 to improve the gain or bandwidth of the first patch 120*a*. The chip antenna 100 may include at least one of the second patch 120*b* and the third patch 120*c*, functioning as radiation patches.

The first patch 120*a*, the second patch 120*b*, and the third patch 120*c* may be formed of one selected from Ag, Au, Cu, Al, Pt, Ti, Mo, Ni and W or an alloy of two or more thereof. The first patch 120*a*, the second patch 120*b*, and the third patch 120*c* may be formed of a conductive paste or a conductive epoxy.

The first patch 120*a*, the second patch 120*b*, and the third patch 120*c* may be prepared by stacking copper foil on ceramic substrates to form electrodes, and then patterning the formed electrodes into a designed shape. An etching process, such as a lithography process, may be used for patterning the electrodes. The electrodes may be formed using subsequent electroplating after forming a seed by electroless plating, and in addition, may be formed using subsequent electroplating after forming a seed by sputtering.

In addition, the first patch 120*a*, the second patch 120*b*, and the third patch 120*c* may be formed by printing and curing a conductive paste or a conductive epoxy on a ceramic substrate. Through a printing process, the first patch 120*a*, the second patch 120*b*, and the third patch 120*c* may be directly formed to have a designed shape without a separate etching process.

According to an example, each of the first patch 120*a*, the second patch 120*b*, and the third patch 120*c* may be provided with a protective layer additionally formed in the form of a film along the surface thereof. The protective layer may be formed on a surface of each of the first patch 120*a*, the second patch 120*b*, and the third patch 120*c* through a plating process. The protective layer may be formed by sequentially laminating a nickel (Ni) layer and a tin (Sn) layer, or by sequentially laminating a zinc (Zn) layer and a tin (Sn) layer. The protective layer is formed on each of the first patch 120*a*, the second patch 120*b*, and the third patch 120*c* to protect oxidation of the first patch 120*a*, the second patch 120*b*, and the third patch 120*c*. The protective layer may also be formed along the surfaces of a feeding pad 130, the feed via 131, a bonding pad 140, and a spacer 150, which will be described later.

The first ceramic substrate 110*a* may be formed of a dielectric substance having a predetermined dielectric constant. As an example, the first ceramic substrate 110*a* may be formed of a sintered ceramic sintered body having a hexahedral shape. The first ceramic substrate 110*a* may include magnesium (Mg), silicon (Si), aluminum (Al), calcium (Ca), and titanium (Ti). As an example, the first ceramic substrate 110*a* may include Mg2Si04, MgAl2O4, and CaTiO3. As another example, the first ceramic substrate 110*a* may further include MgTiO3 in addition to Mg2SiO4, MgAl2O4, and CaTiO3, and according to an example, MgTiO3 replaces CaTiO3, such that the first ceramic substrate 110*a* may include Mg2SiO4, MgAl2O4, and CaTiO3, MgTiO3.

When a distance between the ground layer 16*b* of the chip antenna module 1 and the first patch 120*a* of the chip antenna 100 corresponds to λ/10 to λ/20, the ground layer 16*b* may efficiently reflect the RF signal output by the chip antenna 100 in an oriented direction.

When the ground layer 16*b* is provided on an upper surface of the substrate 10, the distance between the ground layer 16*b* of the chip antenna module 1 and the first patch 120*a* of the chip antenna 100 is substantially the same as a sum of a thickness of the first ceramic substrate 110*a* and a thickness of the bonding pad 140.

Therefore, the thickness of the first ceramic substrate 110*a* may be determined depending on a design distance λ/10 to λ/20 of the ground layer 16*b* and the first patch 120*a*. As an example, the thickness of the first ceramic substrate 110*a* may correspond to 90 to 95% of λ/10 to λ/20. As an example, when the dielectric constant of the first ceramic substrate 110*a* is 5 to 12 at 28 GHz, the thickness of the first ceramic substrate 110*a* may be 150 to 500 μm.

The first patch 120*a* is provided on one surface of the first ceramic substrate 110*a*, and the feeding pad 130 is provided on the other surface of the first ceramic substrate 110*a*. At least one feeding pad 130 may be provided on the other surface of the first ceramic substrate 110*a*. The feeding pad 130 may have a thickness of 20 μm.

The feeding pad 130 provided on the other surface of the first ceramic substrate 110*a* is electrically connected to the feeding pad 16*a* provided on one surface of the substrate 10. The feeding pad 130 is electrically connected to the feed via 131 penetrating through the first ceramic substrate 110*a* in a thickness direction, and the feed via 131 may provide a feed signal to the first patch 110*a* provided on one surface of the first ceramic substrate 110*a*. As the feed via 131, at least one or more feed vias 131 may be provided. As an example, two feed vias 131 may be provided to correspond to two feeding pads 130. One of the two feed vias 131 corresponds to a feed line for generating vertical polarization, and the other feed via 131 corresponds to a feed line for generating horizontal polarization. A diameter of the feed via 131 may be 150 μm. The bonding pad 140 is provided on the other surface of the first ceramic substrate 110*a*. The bonding pad 140 provided on the other surface of the first ceramic substrate 110*a* is bonded to the upper surface pad 16*c* provided on one surface of the substrate 10. For example, the bonding pad 140 of the chip antenna 100 may be bonded to the upper surface pad 16*c* of the substrate 10 through solder paste. A thickness of the bonding pad 140 may be 20 μm.

Referring to A of FIG. 4D, the bonding pad 140 is provided as a plurality of bonding pads, which may be provided at respective corners of a quadrangular shape on the other surface of the first ceramic substrate 110*a*.

Referring to B of FIG. 4D, the plurality of bonding pads 140 may be spaced apart from each other on the other surface of the first ceramic substrate 110*a* by a predetermined distance, along one side of a quadrangular shape and the other opposing side.

Referring to C of FIG. 4D, the plurality of bonding pads 140 may be provided on the other surface of the first ceramic substrate 110*a* by being spaced apart by a predetermined distance along each of four sides of a quadrangular shape.

Referring to D of FIG. 4D, the bonding pads 140 may be provided along each of one side and the other side of a quadrangular shape, opposite to each other, on the other surface of the first ceramic substrate 110*a*, and may respectively have a length corresponding to one side and the other side.

Referring to E of FIG. 4D, the bonding pad 140 is provided along respective four sides of a quadrangular shape to have a length corresponding to the four sides on the other surface of the first ceramic substrate 110*a*.

In A, B and C of FIG. 4D, although the bonding pads 140 are illustrated as having a quadrangular shape, according to an example, the bonding pad 140 may be formed to have various shapes such as a circle or the like. In addition, although A, B, C, D and E of FIG. 4D illustrate that the bonding pads 140 are disposed adjacent to four sides of the quadrangular shape, the bonding pads 140 may also be disposed to be spaced apart from four sides by a predetermined distance according to an example.

The second ceramic substrate 110*b* may be formed of a dielectric substance having a predetermined dielectric constant. For example, the second ceramic substrate 110*b* may be formed of a ceramic sintered body having a hexahedral shape, similar to that of the first ceramic substrate 110*a*. The second ceramic substrate 110*b* may have the same dielectric constant as the first ceramic substrate 110*a*, and according to an example, may also have a dielectric constant different from that of the first ceramic substrate 110*a*. For example, the dielectric constant of the second ceramic substrate 110*b* may be higher than the dielectric constant of the first ceramic substrate 110*a*. According to an example, when the dielectric constant of the second ceramic substrate 110*b* is higher than the dielectric constant of the first ceramic substrate 110*a*, the RF signal is radiated toward the second ceramic substrate 110*b* having a relatively high dielectric constant, and thus, the gain of the RF signal may be improved.

The second ceramic substrate 110*b* may have a thickness less than the thickness of the first ceramic substrate 110*a*. The thickness of the first ceramic substrate 110*a* may correspond to 1 to 5 times the thickness of the second ceramic substrate 110*b*, and for example, may correspond to 2 to 3 times the thickness of the second ceramic substrate 110*b*. As an example, the thickness of the first ceramic substrate 110*a* may be 150 to 500 μm, and the thickness of the second ceramic substrate 110*b* may be 100 to 200 μm, and for example, the thickness of the second ceramic substrate 110*b* may be 50 to 200 μm. The second ceramic substrate 110*b* may have the same thickness as the thickness of the first ceramic substrate 110*a*.

According to an example, depending on the thickness of the second ceramic substrate 110*b*, the first patch 120*a*, the second patch 120*b* and the third patch 120*c* maintain an appropriate distance, such that radiation efficiency of the RF signal may be improved.

The dielectric constant of the first ceramic substrate 110*a* and the second ceramic substrate 110*b* may be higher than a dielectric constant of the substrate 10, for example, a dielectric constant of the insulating layer 17 provided on the substrate 10. As an example, the dielectric constants of the first ceramic substrate 110*a* and the second ceramic substrate 110*b* may be 5 to 12 at 28 GHz, and the dielectric constant of the substrate 10 may be 3 to 4 at 28 GHz. As a result, the volume of the chip antenna may be reduced, thereby miniaturizing an overall chip antenna module. For example, the chip antenna 100 according to an example may be manufactured in the form of a small-sized chip having a length of 3.4 mm, a width of 3.4 mm, and a height of 0.64 mm. The second patch 120*b* is provided a first surface of the second ceramic substrate 110*b*, and the third patch 120*c* is provided on a second surface, which opposes the first surface, of the second ceramic substrate 110*b*.

Figure 4E:
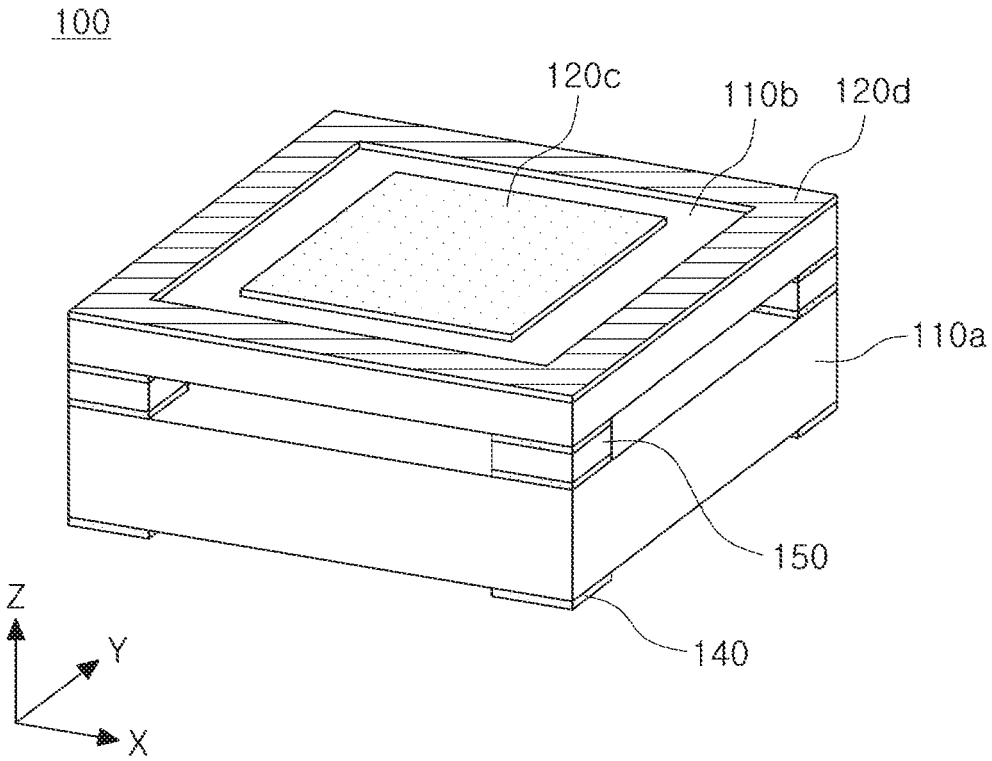
FIG. 4E is a perspective view of a modified example of the chip antenna of FIG. 4A.

Referring to FIG. 4E, one surface of the second ceramic substrate 110*b* is provided with a shielding electrode 120*d* that is insulated from the third patch 120*c* and formed along an edge of the second ceramic substrate 110*b*. The shielding electrode 120*d* may reduce interference between the chip antennas 100 when the chip antennas 100 are arranged in an array such as an n×1 structure or the like. Thus, when the chip antennas 100 are arranged in an array of 4×1, the chip antenna module 1 according to an example may be manufactured as a small-sized module having a length of 19 mm, a width of 4.0 mm, and a height of 1.04 mm.

The first ceramic substrate 110*a* and the second ceramic substrate 110*b* may be spaced apart from each other through the spacer 150. The spacer 150 may be provided at respective corners of a quadrangular shape of the first ceramic substrate 110*a*/the second ceramic substrate 110*b*, between the first ceramic substrate 110*a* and the second ceramic substrate 110*b*. According to an example, the spacer 150 is provided on one side and the other side of the quadrangular shape of the first ceramic substrate 110*a*/the second ceramic substrate 110*b*, or is provided with four sides of the quadrangular shape of the first ceramic substrate 110*a*/the second ceramic substrate 110*b*, thereby the second ceramic substrate 110*b* may be stably supported on the upper part of the first ceramic substrate 110*a*. Therefore, by the spacer 150, a gap may be provided between the first patch 120*a* provided on one surface of the first ceramic substrate 110*a* and the second patch 120*b* provided on the other surface of the second ceramic substrate 110*b*. As air having a dielectric constant of 1 is filled in the space formed by the gap, the overall dielectric constant of the chip antenna 100 may be lowered.

According to an example, the chip antenna module may be miniaturized by forming the first ceramic substrate 110*a* and the second ceramic substrate 110*b* with a material having a dielectric constant higher than the dielectric constant of the substrate 10. By providing a gap between the first ceramic substrate 110*a* and the second ceramic substrate 110*b* to lower the overall dielectric constant of the chip antenna 100, radiation efficiency and gain may be improved.

FIGS. 5A through 5F are manufacturing process diagrams illustrating a method of manufacturing a chip antenna according to the first example. In FIGS. 5A through 5F, one chip antenna is illustrated to be manufactured separately, but according to an example, after a plurality of chip antennas are integrally formed through a manufacturing method described below, the plurality of chip antennas integrally formed may be separated into individual chip antennas through a cutting process.

Figure 5A:
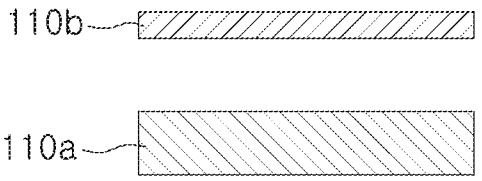
FIGS. 5A, 5B, 5C, 5D, 5E, and 5F are manufacturing process diagrams illustrating a method of manufacturing a chip antenna according to the first example.
Figure 5B:
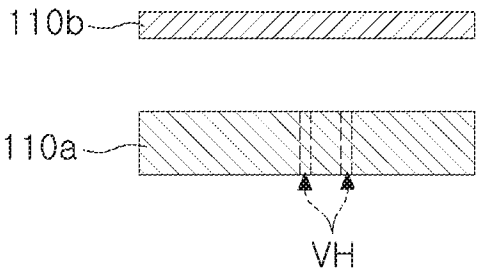
Figure 5C:
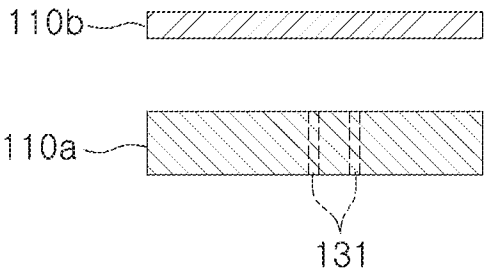

Referring to FIGS. 5A through 5F, a method of manufacturing a chip antenna according to an example starts with preparing a first ceramic substrate 110*a* and a second ceramic substrate 110*b* (see FIG. 5A). Next, via holes VH are formed to penetrate through the first ceramic substrate 110*a* in a thickness direction (see FIG. 5B), and conductive paste is applied or filled in the via holes VH (see FIG. 5C) to form feed vias 131. The conductive paste may be filled in the entire interior of the via holes VH, or may be applied to an inner surface of the via holes VH with a predetermined thickness.

Figure 5D:
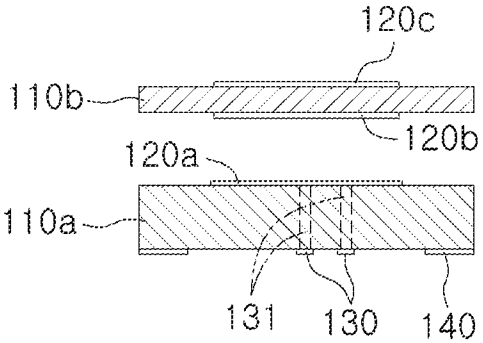

After the feed vias 131 are formed, a conductive paste or a conductive epoxy is printed and cured on the first ceramic substrate 110*a* and the second ceramic substrate 110*b*, to form a first patch 120*a* on one surface of the first ceramic substrate 110*a* and form feeding pads 130 and bonding pads 140 on the other surface of the first ceramic substrate 110*a*, and to form a second patch 120*b* on the other surface of the second ceramic substrate 110*b* and a third patch 120*c* on one surface of the second ceramic substrate 110*b* (see FIG. 5D).

Figure 5E:
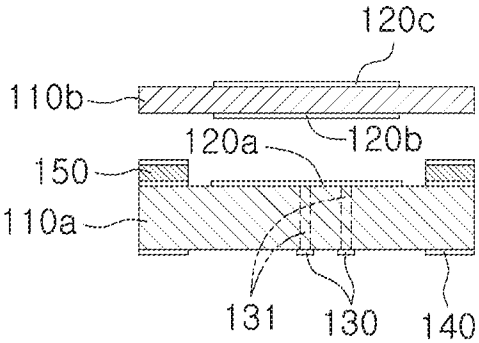
Figure 5F:
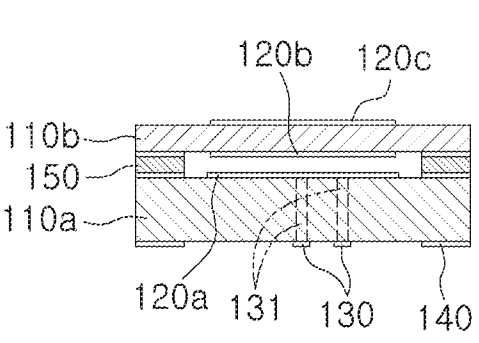

Subsequently, a conductive paste or a conductive epoxy is thick-film printed and cured on an edge of one surface of the first ceramic substrate 110*a* to form a spacer 150 (see FIG. 5E). After the spacer 150 is formed, the conductive paste or the conductive epoxy is additionally printed one or more times in a region in which the spacer 150 is formed, and before the additionally printed conductive paste or conductive epoxy is cured, the second ceramic substrate 110*b* is pressed with the spacer 150 (see FIG. 5F). Subsequently, after the conductive paste or the conductive epoxy provided in the region in which the spacer 150 is formed is cured, a protective layer is formed on the first patch 120*a*, the second patch 120*b*, the third patch 120*c*, the feeding pads 130, the feed vias 131, the bonding pads 140, and the spacer 150 through a plating process. The protective layer may prevent oxidation of the first patch 120*a*, the second patch 120*b*, the third patch 120*c*, the feeding pads 130, the feed vias 131, the bonding pads 140, and the spacer 150. Subsequently, a plurality of chip antennas formed integrally are separated through a cutting process, such that individual chip antennas may be manufactured.

Figure 6A:
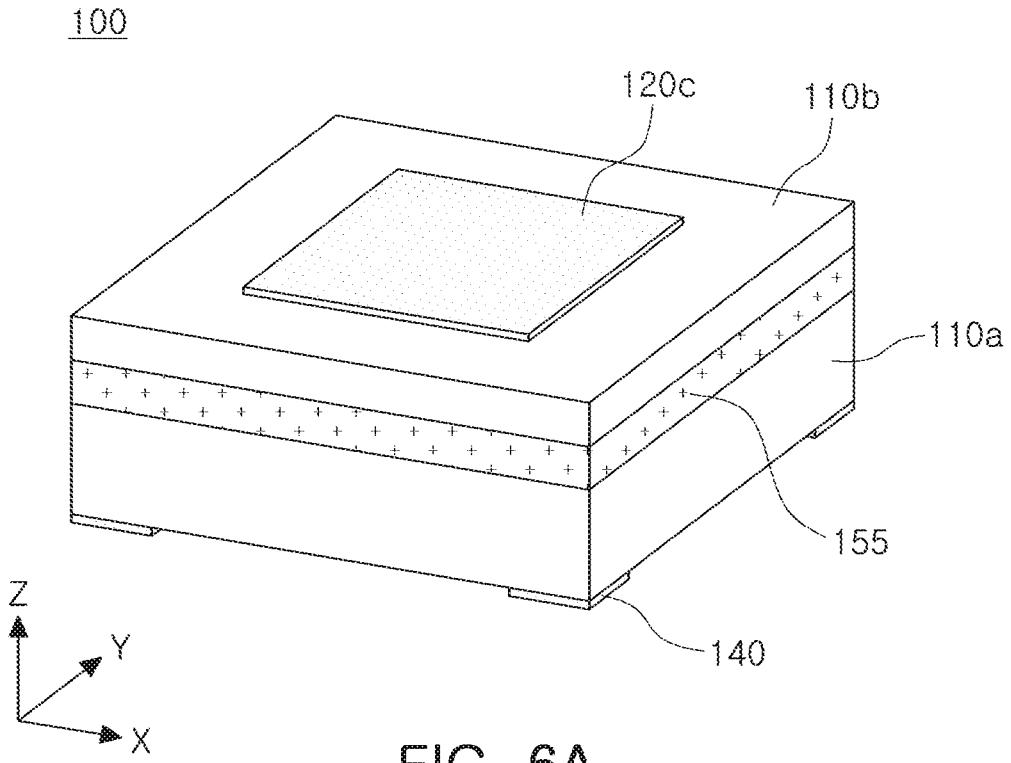
FIG. 6A is a perspective view of a chip antenna according to a second example.
Figure 6B:
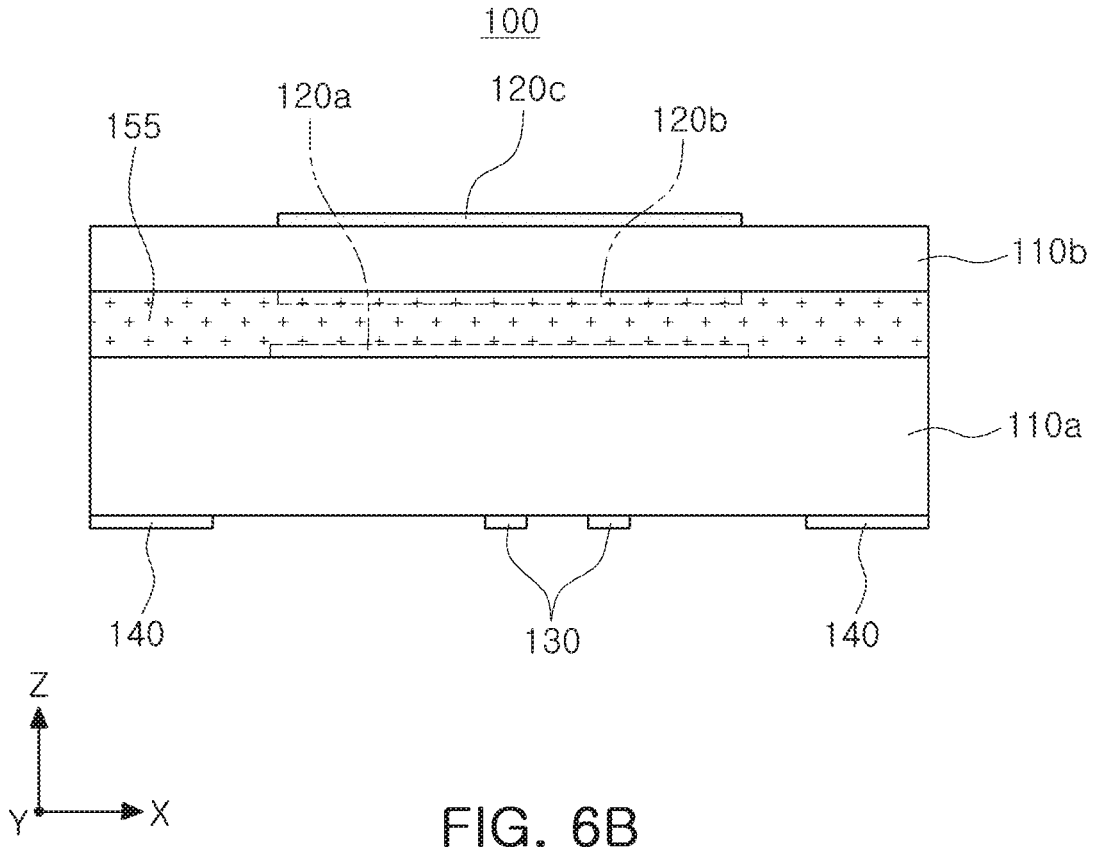
FIG. 6B is a side view of the chip antenna of FIG. 6A.
Figure 6C:
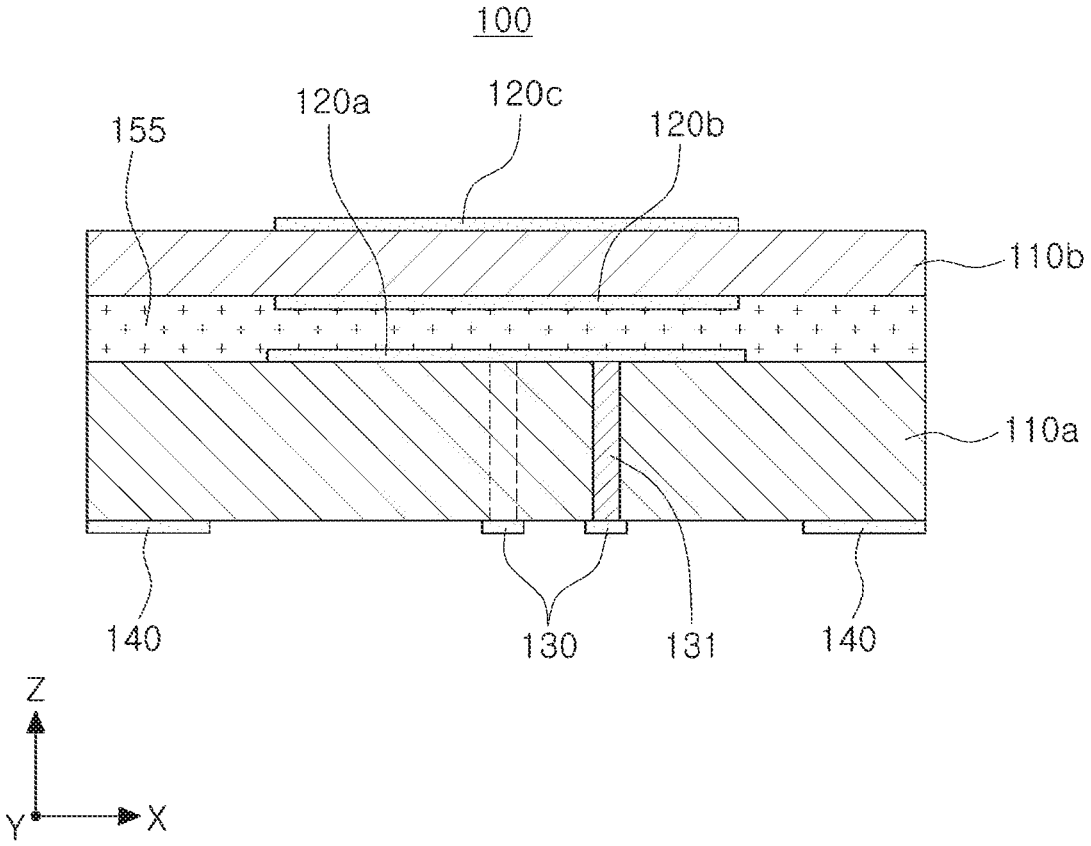
FIG. 6C is a cross-sectional view of the chip antenna of FIG. 6A.

FIG. 6A is a perspective view of a chip antenna according to a second example, FIG. 6B is a side view of the chip antenna of FIG. 6A, and FIG. 6C is a cross-sectional view of the chip antenna of FIG. 6A. Since the chip antenna according to the second example has some overlapping features with the chip antenna according to the first example, overlapping descriptions will be omitted and descriptions will be made based on differences.

While the first ceramic substrate 110*a* and the second ceramic substrate 110*b* of the chip antenna 100 according to the first example are disposed to be spaced apart from each other through the spacer 150, in the case of a chip antenna 100 according to the second example, a first ceramic substrate 110*a* and a second ceramic substrate 110*b* may be bonded to each other through a bonding layer 155. The bonding layer 155 of the second example may be understood to be provided in a space formed by a gap between the first ceramic substrate 110*a* and the second ceramic substrate 110*b* of the first example.

The bonding layer 155 is formed to cover one surface of the first ceramic substrate 110*a* and the other surface of the second ceramic substrate 110*b*, thereby overall bonding the first ceramic substrate 110*a* and the second ceramic substrate 110*b*. The bonding layer 155 may be formed of, for example, a polymer, and for example, the polymer may include a polymer sheet. A dielectric constant of the bonding layer 155 may be lower than the dielectric constant of the first ceramic substrate 110*a* and the second ceramic substrate 110*b*. For example, the dielectric constant of the bonding layer 155 may be 2 to 3 at 28 GHz, and the thickness of the bonding layer 155 may be 50 to 200 μm.

According to an example, a chip antenna module may be miniaturized by forming the first ceramic substrate 110*a* and the second ceramic substrate 110*b* with a material having a dielectric constant higher than the dielectric constant of the substrate 10, and further, a material having a lower dielectric constant than the dielectric constant of each of the first ceramic substrate 110*a* and the second ceramic substrate 110*b* is provided between the first ceramic substrate 110*a* and the second ceramic substrate 110*b*, to lower the overall dielectric constant of the chip antenna 100, thereby improving radiation efficiency and gain.

FIGS. 7A through 7F are manufacturing process drawings illustrating a method of manufacturing a chip antenna according to the second example.

Figure 7A:
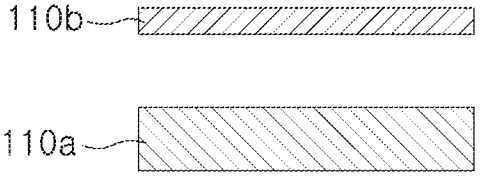
FIGS. 7A, 7B, 7C, 7D, 7E, and 7F are manufacturing process drawings illustrating a method of manufacturing the chip antenna according to the second example.
Figure 7B:
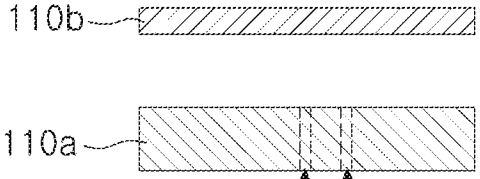
Figure 7C:
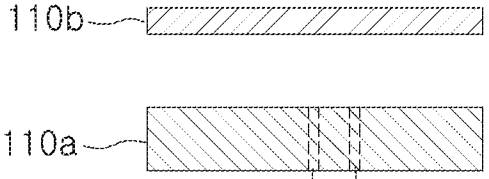

Referring to FIGS. 7A through 7F, a method of manufacturing a chip antenna according to an example starts with providing a first ceramic substrate 110*a* and a second ceramic substrate 110*b* (see FIG. 7A). Subsequently, via holes VH are formed to penetrate through the first ceramic substrate 110*a* in a thickness direction (see FIG. 7B), and conductive paste is applied or filled in the via holes VH (see FIG. 7C) to form feed vias 131. The conductive paste may be filled in the entire interior of the via holes VH, or may be applied to an inner surface of the via holes VH with a predetermined thickness.

Figure 7D:
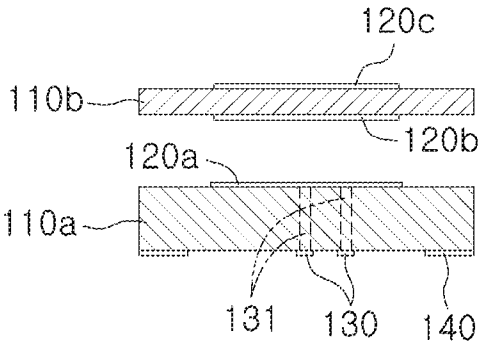

After the feed vias 131 are formed, a conductive paste or a conductive epoxy is printed and cured on the first ceramic substrate 110*a* and the second ceramic substrate 110*b*, to form a first patch 120*a* on one surface of the first ceramic substrate 110*a* and form feeding pads 130 and bonding pads 140 on the other surface of the first ceramic substrate 110*a*, and to form a second patch 120*b* on the other surface of the second ceramic substrate 110*b* and a third patch 120*c* on one surface of the second ceramic substrate 110*b* (see FIG. 7D). Subsequently, a protective layer is formed on the first patch 120*a*, the second patch 120*b*, the third patch 120*c*, the feeding pads 130, the feed vias 131, and the bonding pad 140 through a plating process. The protective layer may prevent oxidation of the first patch 120*a*, the second patch 120*b*, the third patch 120*c*, the feeding pads 130, the feed vias 131, and the bonding pads 140.

Figure 7E:
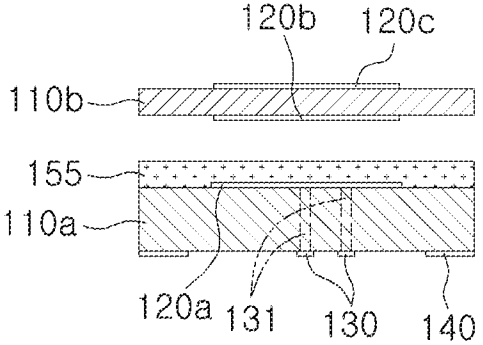
Figure 7F:
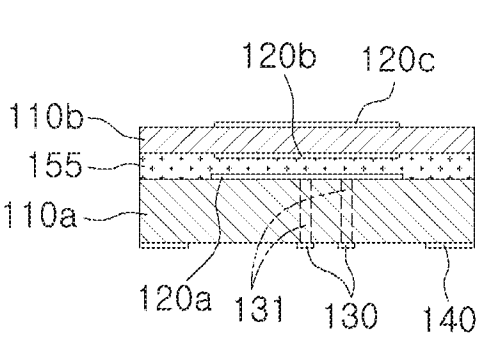

After the protective layer is formed, a bonding layer 155 is formed to cover one surface of the first ceramic substrate 110*a* (see FIG. 7E). After the bonding layer 155 is formed, the second ceramic substrate 110*b* and the first ceramic substrate 110*a* are pressed with each other (see FIG. 7F). After the bonding layer 155 is cured, a plurality of integrally formed chip antennas are separated from each other through a cutting process, such that individual chip antennas may be manufactured.

Figure 8A:
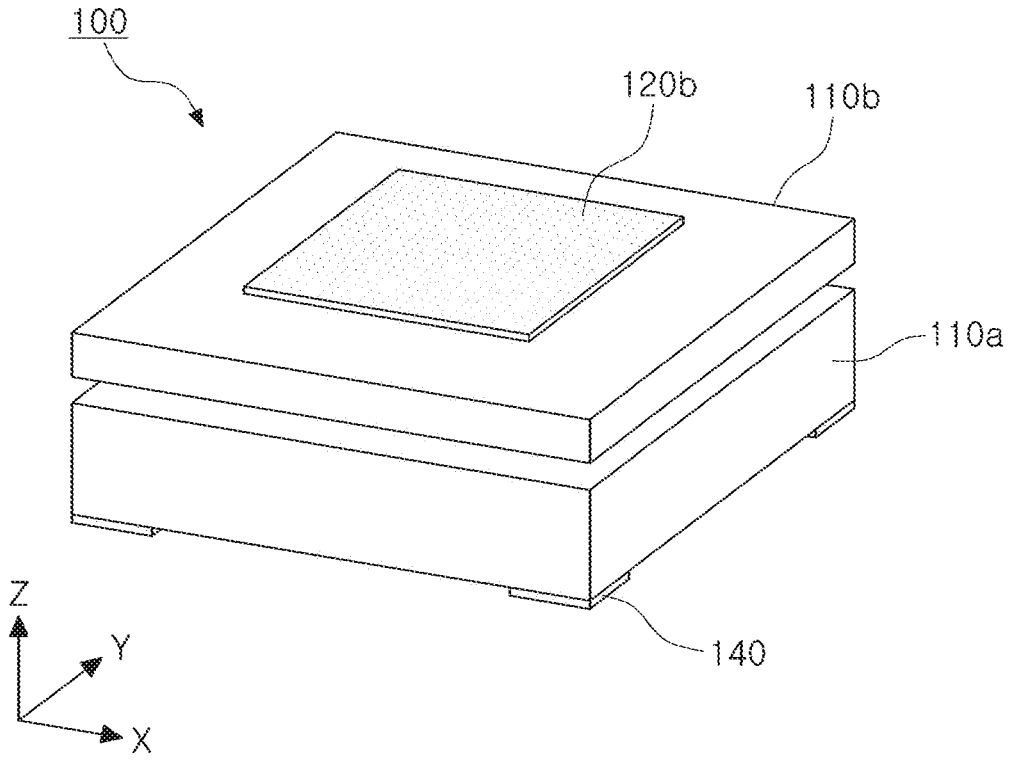
FIG. 8A is a perspective view of a chip antenna according to a third example.
Figure 8B:
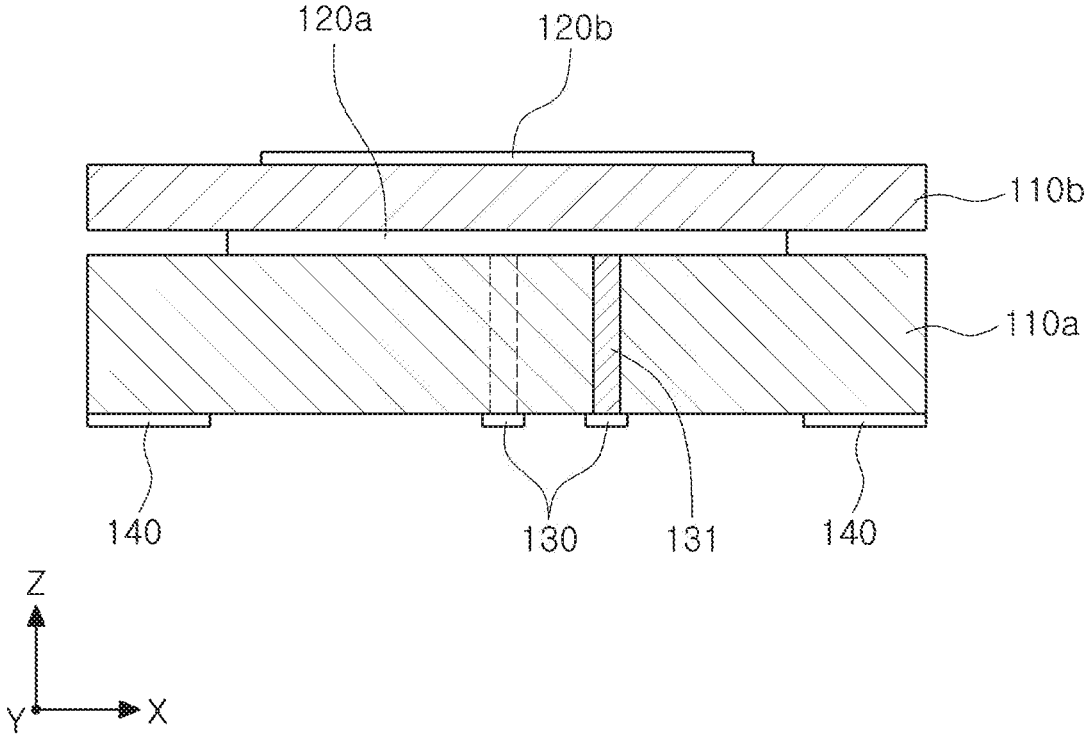
FIG. 8B is a cross-sectional view of the chip antenna of FIG. 8A.

FIG. 8A is a perspective view of a chip antenna according to a third example, and FIG. 8B is a cross-sectional view of the chip antenna of FIG. 8A. Since the chip antenna according to the third example has some overlapping features with the chip antenna according to the first example, overlapping descriptions will be omitted, and descriptions will be made based on differences.

The first ceramic substrate 110*a* and the second ceramic substrate 110*b* of the chip antenna 100 according to the first example are spaced apart from each other through the spacer 150, whereas a first ceramic substrate 110*a* and a second ceramic substrate 110*b* of the chip antenna 100 according to the third example may be bonded to each other with a first patch 120*a* therebetween.

For example, the first patch 120*a* is provided on one surface of the first ceramic substrate 110*a*, and the second patch 120*b* is provided on one surface of the second ceramic substrate 110*b*. The first patch 120*a* provided on one surface of the first ceramic substrate 110*a* may be bonded to the other surface of the second ceramic substrate 110*b*. Therefore, the first patch 120*a* may be interposed between the first ceramic substrate 110*a* and the second ceramic substrate 110*b*.

FIGS. 9A through 9E are manufacturing process diagrams illustrating a method of manufacturing a chip antenna according to a third example.

Figure 9A:
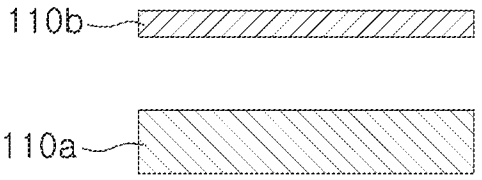
FIGS. 9A, 9B, 9C, 9D, and 9E are manufacturing process diagrams illustrating a method of manufacturing the chip antenna according to the third example.
Figure 9B:
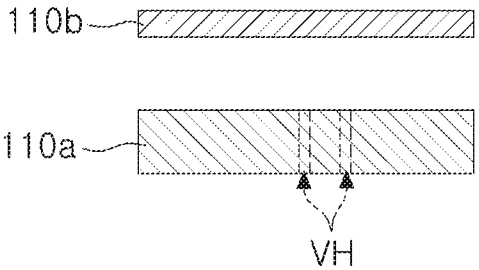
Figure 9C:
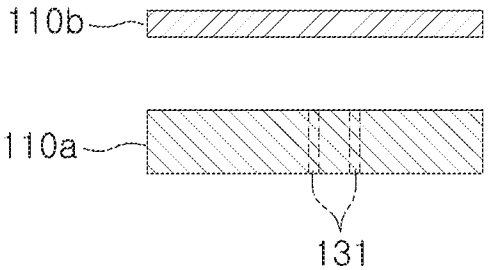

Referring to FIGS. 9A through 9E, a method of manufacturing a chip antenna according to an example starts with preparing a first ceramic substrate 110*a* and a second ceramic substrate 110*b* (FIG. 9A). Subsequently, via holes VH penetrating through the first ceramic substrate 110*a* in the thickness direction are formed (FIG. 9B), and a conductive paste is applied or filled inside the via holes VH (FIG. 9C) to form feed vias 131. The conductive paste may be filled in the entire interior of the via holes VH, or may be applied on the inner surfaces thereof to a predetermined thickness.

Figure 9D:
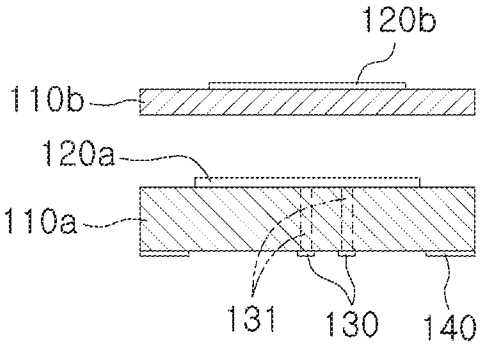
Figure 9E:
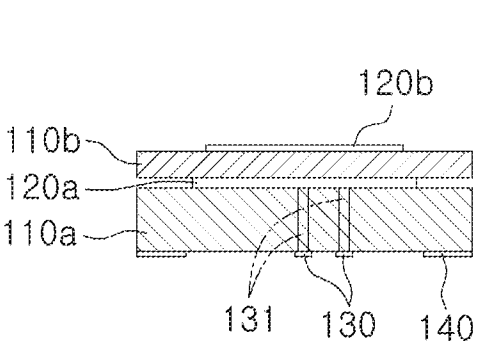

After the feed vias 131 are formed, a conductive paste or a conductive epoxy is printed and cured on the first ceramic substrate 110*a* and the second ceramic substrate 110*b* to form a first patch 120*a* on one surface of the first ceramic substrate 110*a* and form feeding pads 130 and bonding pads 140 on the other surface of the first ceramic substrate 110*a*, and to form a second patch 120*b* on one surface of the second ceramic substrate 110*b* (see FIG. 9D). Subsequently, the conductive paste or the conductive epoxy is additionally printed one or more times in a region in which the first patch 120*a* is formed, and before the additionally printed conductive paste or conductive epoxy is cured, the second ceramic substrate 110*b* is pressed with the first patch 120*a* (see FIG. 9E). After the first patch 120*a* is cured, a protective layer is formed on the second patch 120*b*, the feeding pads 130, the feed vias 131, and the bonding pads 140 through a plating process. The protective layer may prevent oxidation of the second patch 120*b*, the feeding pads 130, the feed vias 131, and the bonding pads 140. Subsequently, a plurality of chip antennas formed integrally are separated through a cutting process, such that individual chip antennas may be manufactured.

Figure 10:
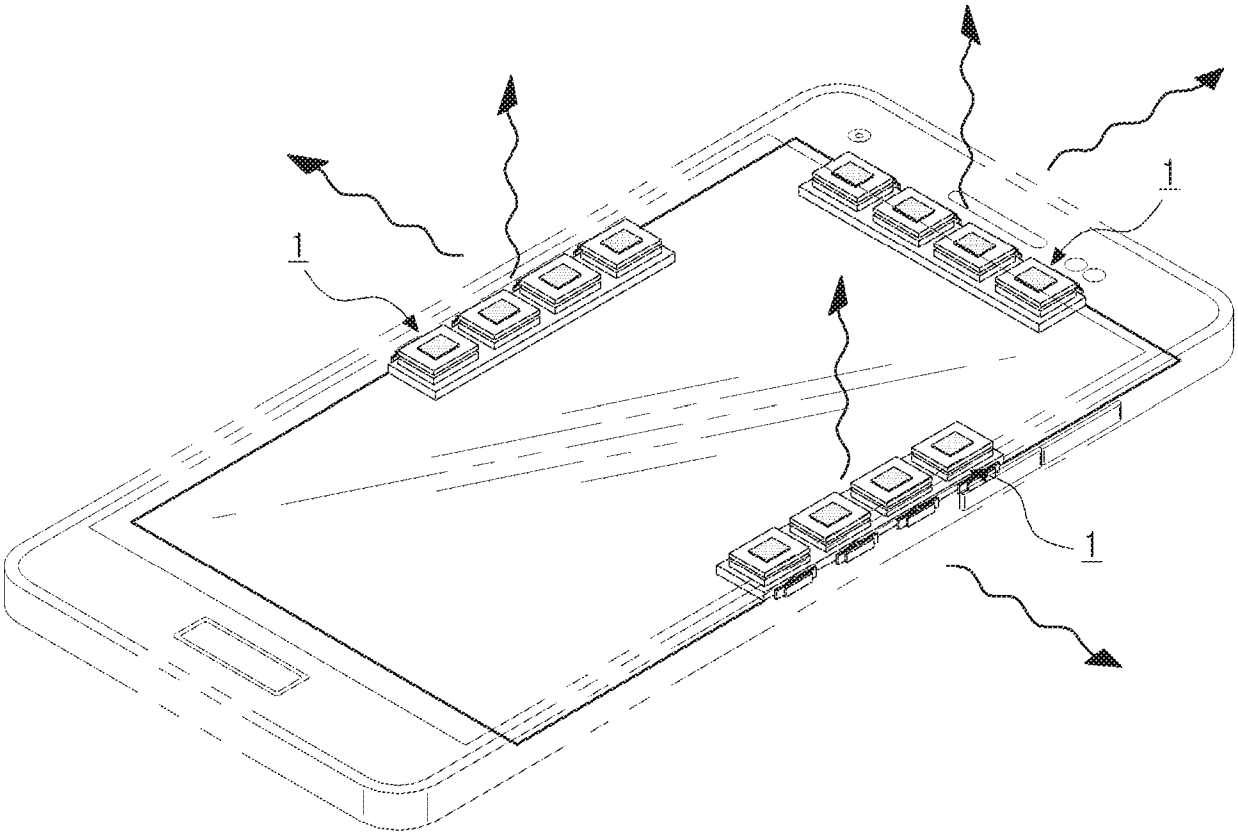
FIG. 10 is a perspective view schematically illustrating a portable terminal equipped with a chip antenna module according to an example.

FIG. 10 is a perspective view schematically illustrating a portable terminal equipped with a chip antenna module according to an example.

Referring to FIG. 10, a chip antenna module 1 according to an example is disposed adjacent to an edge of a portable terminal. As an example, chip antenna modules 1 are disposed on sides of the portable terminal in a longitudinal direction or side thereof in a width direction, to face each other. In this example, the case in which the chip antenna modules 1 are disposed on both sides of the portable terminal in the longitudinal direction and both sides of the portable terminal in the width direction is illustrated, but examples thereof are not limited thereto. The arrangement structure of the chip antenna module may be modified in various forms as necessary, and for example, only two chip antenna modules may be disposed in a diagonal direction of the portable terminal in a case in which an internal space of the portable terminal is insufficient. The RF signal radiated through the chip antenna of the chip antenna module 1 radiates in the thickness direction of the mobile terminal, and the RF signal radiated through the end-fire antenna of the chip antenna module 1 radiates in a direction perpendicular to the side of the mobile terminal in the longitudinal direction or the side thereof in the width direction.

As set forth above, according to the examples, a patch antenna implemented in a pattern form in the related art multilayer substrate may be implemented to have a chip form, thereby significantly reducing the number of layers of a substrate on which a chip antenna is mounted and thus reducing manufacturing costs and the volume of a chip antenna module.

According to the examples, ceramic substrates provided in a chip antenna are formed to have a dielectric constant higher than a dielectric constant of an insulating layer provided in a substrate, thereby miniaturizing a chip antenna.

According to the examples, ceramic substrates of a chip antenna may be spaced apart from each other by a predetermined distance, or a material having a lower dielectric constant than that of ceramic substrates may be disposed between the ceramic substrates, thereby lowering an overall dielectric constant of a chip antenna. As a result, a wavelength of an RF signal may be increased, while miniaturizing a chip antenna module, thereby improving radiation efficiency and gain.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna comprising:

a first ceramic substrate;

a second ceramic substrate disposed to face the first ceramic substrate;

a first patch disposed on a first surface of the first ceramic substrate and configured to operate as a feeding patch;

a second patch disposed on the second ceramic substrate and configured to operate as a radiation patch;

at least one feed via penetrating through the first ceramic substrate in a thickness direction and configured to provide a feed signal to the first patch;

a bonding layer disposed between the first ceramic substrate and the second ceramic substrate; and a bonding pad disposed on a second surface of the first ceramic substrate opposite the first surface, wherein a thickness of the first ceramic substrate is greater than a thickness of the second ceramic substrate.

2. The chip antenna of claim 1, wherein the thickness of the first ceramic substrate is equal to two to three times the thickness of the second ceramic substrate.

3. The chip antenna of claim 1, wherein the thickness of the first ceramic substrate is 150 to 500 μm.

4. The chip antenna of claim 1, wherein the thickness of the second ceramic substrate is 50 to 200 μm.

5. The chip antenna of claim 1, wherein a dielectric constant of the bonding layer is lower than a dielectric constant of the first ceramic substrate and a dielectric constant of the second ceramic substrate.

6. The chip antenna of claim 1, wherein the bonding layer is formed of a polymer, and is configured to bond the first ceramic layer to the second ceramic layer.

7. A chip antenna module comprising:

a substrate comprising a plurality of wiring layers alternately stacked with a plurality of insulating layers; and a chip antenna comprising:

a first ceramic substrate comprising a first patch to which a feed signal is applied, the first ceramic substrate being disposed on one surface of the substrate; and a second ceramic substrate comprising a second patch coupled to the first patch, the second ceramic substrate being disposed to face the first ceramic substrate, wherein a dielectric constant of the first ceramic substrate and a dielectric constant of the second ceramic substrate are higher than a dielectric constant of the insulating layers.

8. The chip antenna module of claim 7, wherein the dielectric constant of the insulating layers is 3 to 4.

9. The chip antenna module of claim 7, wherein the dielectric constant of each of the first ceramic substrate and the second ceramic substrate is 5 to 12.

10. The chip antenna module of claim 7, wherein the dielectric constant of the first ceramic substrate is the same as the dielectric constant of the second ceramic substrate.

11. The chip antenna module of claim 7, wherein an overall dielectric constant of the chip antenna is lower than the dielectric constant of the first ceramic substrate and the dielectric constant of the second ceramic substrate.

12. The chip antenna module of claim 7, further comprising a spacer disposed between the first ceramic substrate and the second ceramic substrate.

13. The chip antenna module of claim 7, further comprising a bonding layer disposed on the first ceramic substrate and the second ceramic substrate, wherein a dielectric constant of the bonding layer is lower than the dielectric constant of each of the first ceramic substrate and the second ceramic substrate.

14. The chip antenna module of claim 7, wherein the first patch is disposed on one surface of the first ceramic substrate facing the second ceramic substrate.

15. The chip antenna module of claim 14, wherein a distance from a ground layer reflecting a radio frequency (RF) signal of the chip antenna in an oriented direction, from among the plurality of wiring layers of the substrate, to the first patch, corresponds to $\lambda/10$ to $\lambda/20$, where $\lambda$ is wavelength of the RF signal transmitted and received by the chip antenna.

16. A chip antenna module comprising:

a substrate;

a chip antenna comprising:

a first ceramic substrate disposed on a first surface of the substrate, the first ceramic substrate comprising a feed patch; and a second ceramic substrate disposed on the first surface of the substrate and spaced apart from the first ceramic substrate in a direction normal to the first surface of the substrate, the second ceramic substrate comprising a radiation patch, wherein a dielectric constant of the first ceramic substrate and a dielectric constant of the second ceramic substrate are higher than a dielectric constant of the substrate.

17. The chip antenna module of claim 16, wherein the radiation patch comprises:

a first radiation patch electromagnetically coupled to the feed patch and disposed on a first surface of the second ceramic substrate that faces the feed patch; and a second radiation patch electromagnetically coupled to the feed patch and disposed on a second surface of the second ceramic substrate opposite to the first surface of the second ceramic substrate.

18. The chip antenna module of claim 17, further comprising a shielding electrode insulated from the second radiation patch and disposed along a periphery of the second surface of the second ceramic substrate.

19. The chip antenna module of claim 16, wherein the feed patch is disposed on a first surface of the first ceramic substrate opposite the first surface of the substrate and bonded to a first surface of the second ceramic substrate that faces the first surface of the of the first ceramic substrate, and the radiation patch is disposed on a second surface of the second ceramic substrate opposite the first surface of the second ceramic substrate.

* * * * *